US010619916B2

(12) United States Patent
Chou et al.

(10) Patent No.: US 10,619,916 B2
(45) Date of Patent: Apr. 14, 2020

(54) DEVICES FOR USE WITH REFRIGERATION DEVICES INCLUDING TEMPERATURE-CONTROLLED CONTAINER SYSTEMS

(71) Applicant: Tokitae LLC, Bellevue, WA (US)

(72) Inventors: Fong-Li Chou, Bellevue, WA (US); Roderick T. Hinman, Kailua Kona, HI (US); Jennifer Ezu Hu, Seattle, WA (US); Fridrik Larusson, Seattle, WA (US); Shieng Liu, Bellevue, WA (US); Brian L. Pal, Medina, WA (US); Matthew W. Peters, Sammamish, WA (US); Nels R. Peterson, Bellevue, WA (US)

(73) Assignee: Tokitae LLC, Bellevue, WA (US)

( * ) Notice: Subject to any disclaimer, the term of this patent is extended or adjusted under 35 U.S.C. 154(b) by 128 days.

(21) Appl. No.: 15/717,192

(22) Filed: Sep. 27, 2017

(65) Prior Publication Data

US 2018/0087831 A1 Mar. 29, 2018

Related U.S. Application Data

(60) Provisional application No. 62/401,367, filed on Sep. 29, 2016.

(51) Int. Cl.
*F25D 31/00* (2006.01)
*F25D 16/00* (2006.01)
(Continued)

(52) U.S. Cl.
CPC ..... *F25D 31/006* (2013.01); *F25B 23/006* (2013.01); *F25D 11/02* (2013.01);
(Continued)

(58) Field of Classification Search
CPC ..... F25D 31/006; F25D 11/02; F25D 16/00; F25D 11/003; F25D 11/006;
(Continued)

(56) References Cited

U.S. PATENT DOCUMENTS 7,040,115 B1 * 5/2006 Lopez ..... F25D 3/08 62/371
8,074,465 B2 * 12/2011 Heroux ..... A01N 1/02 62/371

(Continued)

OTHER PUBLICATIONS

PCT International Search Report; International App. No. PCT/US2017/054065; dated Jan. 16, 2018; pp. 1-3.

*Primary Examiner* — Melvin Jones

(57) ABSTRACT

A refrigeration device includes a thermal transfer unit with an evaporative region, an adiabatic region, and a condensing region with a reversible valve attached to the adiabatic region. The device includes a container sealed around PCM, with a set of refrigeration coils of a compressor unit in thermal contact with the PCM. A storage region is in thermal contact with the evaporative region of the thermal transfer unit. A controller is operably connected to the reversible valve and the refrigeration compressor unit. The storage region can be used to store cold packs within a predetermined temperature range for medical outreach.

22 Claims, 13 Drawing Sheets

(51) Int. Cl.
*F25B 23/00* (2006.01)
*F25D 11/02* (2006.01)
*F25D 11/00* (2006.01)

(52) U.S. Cl.
CPC ..... *F25D 16/00* (2013.01); *F25D 11/003* (2013.01); *F25D 11/006* (2013.01); *F25D 2303/08* (2013.01); *F25D 2331/8014* (2013.01); *F25D 2400/02* (2013.01); *F25D 2700/123* (2013.01); *F25D 2700/16* (2013.01)

(58) Field of Classification Search
CPC ..... F25D 2303/08; F25D 2331/8014; F25D 2400/02; F25D 2700/123; F25D 2700/16; F25B 23/006; F25B 3/08; F25B 2303/0832; F25B 2303/0843
See application file for complete search history.

(56) References Cited

U.S. PATENT DOCUMENTS

| | | | | |
|---|---|---|---|---|
| 9,523,522 | B2 * | 12/2016 | Chou | F25B 39/028 |
| 2005/0132734 | A1 * | 6/2005 | Narayanamurthy | F24F 5/0017 62/201 |
| 2007/0095093 | A1 * | 5/2007 | Narayanamurthy | F24F 5/0017 62/434 |
| 2015/0143831 | A1 | 5/2015 | Chou et al. | |
| 2015/0292775 | A1 | 10/2015 | Ma et al. | |
| 2017/0176083 | A1 * | 6/2017 | Sul | F25B 5/02 |

* cited by examiner

DEVICES FOR USE WITH REFRIGERATION DEVICES INCLUDING TEMPERATURE-CONTROLLED CONTAINER SYSTEMS

If an Application Data Sheet (ADS) has been filed on the filing date of this application, it is incorporated by reference herein. Any applications claimed on the ADS for priority under 35 U.S.C. §§ 119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC § 119(e) for provisional patent applications, for any and all parent, grandparent, great-grandparent, etc. applications of the Priority Application(s)).

PRIORITY APPLICATIONS

The present application claims benefit of priority of U.S. Provisional Patent Application No. 62/401,367, entitled DEVICES FOR USE WITH REFRIGERATION DEVICES INCLUDING TEMPERATURE-CONTROLLED CONTAINER SYSTEMS, naming FONG-LI CHOU, RODERICK T. HINMAN, JENNIFER EZU HU, FRIDRIK LARUSSON, SHIENG LIU, BRIAN L. PAL, MATTHEW W. PETERS AND NELS R. PETERSON as inventors, filed 29 Sep. 2016, which was filed within the twelve months preceding the filing date of the present application or is an application of which a currently co-pending priority application is entitled to the benefit of the filing date.

If the listings of applications provided above are inconsistent with the listings provided via an ADS, it is the intent of the Applicant to claim priority to each application that appears in the Domestic Benefit/National Stage Information section of the ADS and to each application that appears in the Priority Applications section of this application.

All subject matter of the Priority Applications and of any and all applications related to the Priority Applications by priority claims (directly or indirectly), including any priority claims made and subject matter incorporated by reference therein as of the filing date of the instant application, is incorporated herein by reference to the extent such subject matter is not inconsistent herewith.

SUMMARY

In some embodiments, a refrigeration device includes: a thermal transfer unit including a set of hollow tubes forming an evaporative region, a set of hollow tubes forming a condensing region, and one or more hollow tubes forming an adiabatic region connecting the evaporative region and the condensing region, wherein the hollow tubes are sealed to each other to for a contiguous interior region; one or more reversible valves operably attached to the one or more hollow tubes forming the adiabatic region; a container with one or more walls sealed to hold a quantity of phase change material (PCM), the one or more walls including an aperture sealed around a set of refrigeration coils and wherein the condensing region of the thermal transfer unit is in thermal contact with the one or more walls; and a controller operably connected to the one or more reversible valves and the refrigeration compressor unit.

In some embodiments, a refrigeration device includes: a first thermal transfer unit including a set of hollow tubes forming a first evaporative region, a set of hollow tubes forming a first condensing region, and one or more hollow tubes forming a first adiabatic region connecting the first evaporative region and the first condensing region, wherein the hollow tubes are sealed to each other to form a first contiguous interior region; at least one first reversible valve operably attached to the one or more hollow tubes forming the first adiabatic region; a first container with one or more walls sealed to hold a quantity of a first phase change material (PCM1), the one or more walls including an aperture sealed around a first set of refrigeration coils and wherein the first condensing region of the first thermal transfer unit is in thermal contact with the one or more walls; a second thermal transfer unit including a set of hollow tubes forming a second evaporative region, a set of hollow tubes forming a second condensing region, and one or more hollow tubes forming a second adiabatic region connecting the second evaporative region and the second condensing region, wherein the hollow tubes are sealed to each other to form a second contiguous interior region; at least one second reversible valve operably attached to the one or more hollow tubes forming the second adiabatic region; a second container with one or more walls sealed to hold a quantity of a second phase change material (PCM2), the one or more walls including an aperture sealed around a second set of refrigeration coils and wherein the second condensing region of the second thermal transfer unit is in thermal contact with the one or more walls; a refrigeration compressor unit including the first set of refrigeration coils, wherein the first set of refrigeration coils traverse the one or more walls of the first container, and the second set of refrigeration coils, wherein the second set of refrigeration coils traverse the one or more walls of the second container; a third reversible valve operably attached to the refrigeration compressor unit at a position to regulate flow through the first set of refrigeration coils and the second set of refrigeration coils, the third reversible valve operably attached to the controller; one or more walls forming a storage region, wherein the first evaporative region of the first thermal transfer unit and the second evaporative region of the second thermal transfer unit are thermal contact with the one or more walls; and a controller operably connected to the at least one first reversible valve, the at least one second reversible valve, and the refrigeration compressor unit.

In some embodiments, a refrigeration device includes: a container with one or more walls sealed to hold a quantity of PCM; a refrigeration compressor unit including the set of refrigeration coils, wherein the set of refrigeration coils are in thermal contact with the PCM; one or more walls forming a storage region; a set of hollow tubes sealed to form a refrigerant loop with a first end of the refrigerant loop in thermal contact with the PCM and a second end of the refrigerant loop in thermal contact with the storage region; a pump operably connected to the refrigerant loop; and a controller operably connected to the pump.

In some embodiments, a refrigeration device includes: a container with one or more walls sealed to hold a quantity of PCM; a first refrigeration compressor unit including the set of refrigeration coils, wherein the set of refrigeration coils are in thermal contact with the PCM; one or more walls forming a storage region; a second refrigeration compressor unit including the set of refrigeration coils, wherein the set of refrigeration coils include a first section in thermal contact with the PCM and a second section in thermal contact with the storage region; and a controller operably connected to the first refrigeration compressor unit and the second refrigeration compressor unit.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
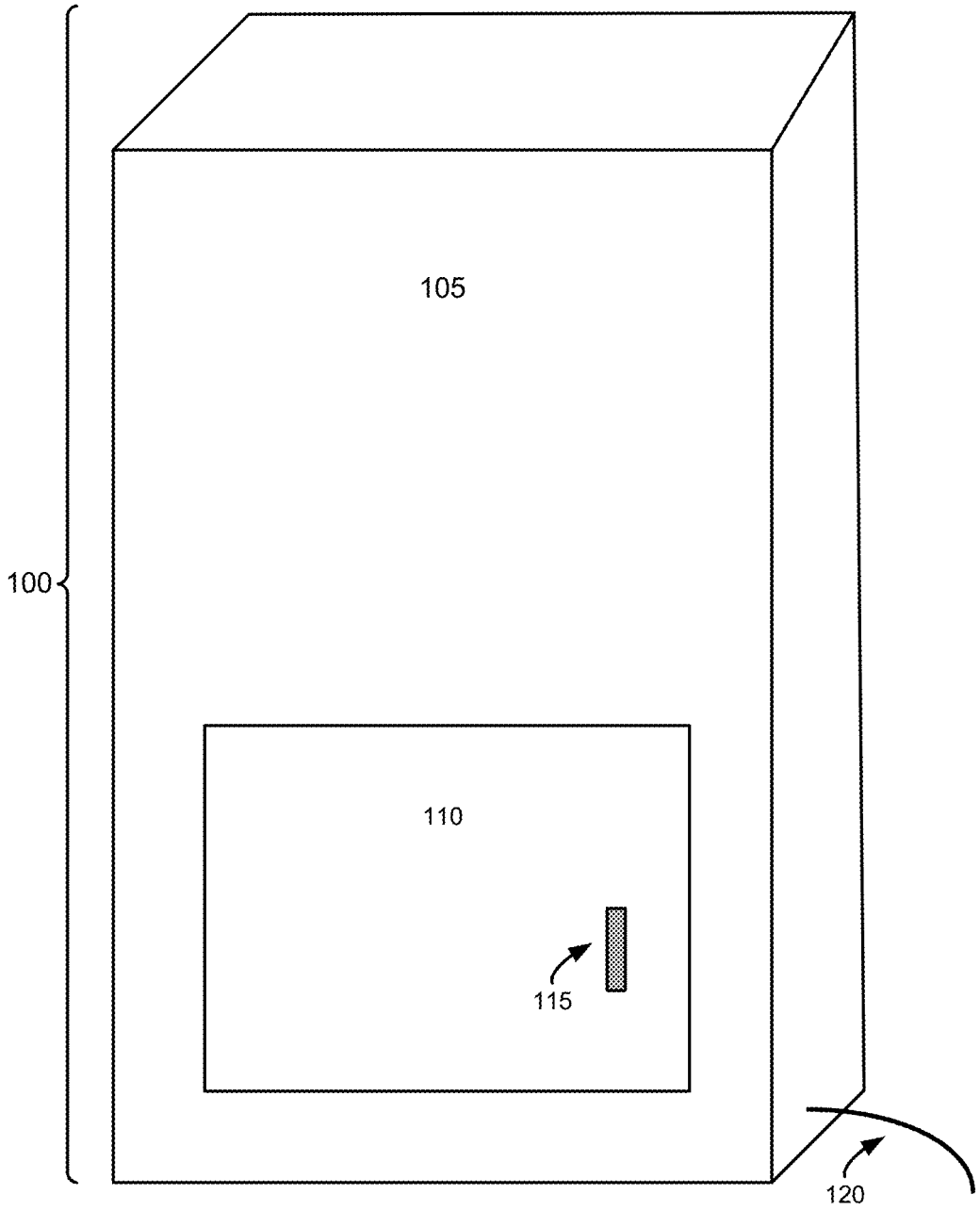
FIG. 1 is a schematic of an external view of a refrigeration device.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Refrigeration devices as described herein are configured for the specialized purpose of maintaining a storage region within a predefined temperature range for support of medical outreach in regions with minimal or inconsistent power availability. These refrigeration devices are designed for use with medicinal materials that must be kept within a narrow temperature range from the time of manufacture to the time of delivery to an individual. Maintenance of this "cold chain" for medicinal materials is crucial for the efficacy of the medicinal materials, but poses distinct logistical challenges to medical outreach in remote and/or low-resource regions. For example, maintenance of the cold chain is more difficult in regions with inconsistent electric power availability (for example, unreliable mains power) as conventional refrigerators can malfunction and not maintain storage temperatures as needed in the absence of reliable electric power.

Many medicinal materials, such as certain vaccines and antibiotics, need to be maintained in a defined temperature range in order to preserve their efficacy. For example, many common vaccines must be kept in a temperature range between 2 degrees Centigrade and 8 degrees Centigrade to preserve their efficacy. For example, some medicinal materials need to be kept in a temperature range above 0 degrees Centigrade and below 10 degrees Centigrade as part of a regulatory storage protocol for the materials. Temperature deviations above or below the predetermined temperature range for a given medicinal material can render the medicinal material ineffective or partially ineffective, resulting in wastage. In situations where public health workers are engaged in mobile or temporary outreach campaigns in remote settings, the loss of medicinal material can result in the failure of the outreach campaign. For example, if public health workers are engaged in a vaccine campaign in a low resource area, loss of vaccine due to temperature deviations during storage can reduce the number of people who can be vaccinated during the limited time available in a given location during the campaign. In a situation of medical outreach into a region suffering from a public health emergency such as an epidemic, loss of vaccine can result in continued spread of the disease with associated morbidity. The loss of medicinal material due to temperature deviations can also necessitate expensive re-stocking and associated delays.

Cold packs are small, portable packages of PCM that are used with a portable cold chain device such as a cooler or an insulated chest to maintain the internal temperature of the portable cold chain device. Cold packs are commonly used in portable coolers by public health workers when storing and transporting medicinal materials for outreach programs and vaccine campaigns in low resource settings in order to maintain the temperature within a portable cooler within a required temperature range as needed to maintain the efficacy of the medicinal material. If a cold pack has been stored, for example, at a temperature significantly below the storage temperature range of a medicinal material, use of the cold pack could cause the medicinal material to be stored at a temperature outside of the preapproved temperature range if the cold pack is not warmed to a temperature closer to the predetermined storage temperature range of the medicinal material. Many commercial freezers, for example, are designed to hold an internal temperature around −20 degrees Centigrade, substantially lower than the temperature range between 2 degrees Centigrade and 8 degrees Centigrade required to preserve efficacy of many common vaccines and the temperature range for associated cold packs. A refrigeration device designed to hold cold packs in an appropriate temperature range for use would minimize the potential for accidental use of cold packs that are significantly above or below the appropriate storage temperature range of medicinal material during temporary storage and transport. Refrigeration devices as described herein are intended for use to store and condition cold packs, particularly to store and condition the cold packs to a predetermined temperature for use with medicinal materials. The refrigeration devices are also energy efficient and maintain temperature of the storage region even during power outages.

The refrigeration devices are designed to operate to bring cold packs to a temperature within the predetermined temperature range even in the absence of power at a particular time. For example, a refrigeration device can have a refrigeration compressor unit operated from solar power during the daytime and still function to cool and condition cold packs to temperatures within a predetermined temperature range during the night when solar power is not available. This can be useful, for example, for medicinal outreach when the cold packs are in portable transport carriers during the day and the cold packs will be returned to a central facility for cooling and conditioning at night.

In some embodiments, a refrigeration device includes: one or more walls substantially forming a liquid-impermeable container, the container configured to hold phase change material internal to a refrigeration device, wherein the one or more walls integrally include a first group of vapor-impermeable structures with a hollow interior connected to form a condenser; at least one active refrigeration unit including a set of evaporator coils, the evaporator coils positioned within an interior of the liquid-impermeable container; one or more walls substantially forming a storage region and integrally including a second group of vapor-impermeable structures with a hollow interior connected to form a evaporator; and a connector affixed to both the condenser and the evaporator, the connector forming a liquid and vapor flow path between the hollow interior of the condenser and the hollow interior of the evaporator, wherein the condenser, the evaporator and the connector form a heat transfer system integral to the refrigeration device.

In some embodiments, a refrigeration device includes: one or more walls substantially forming a liquid-impermeable container, the container configured to hold phase change material internal to a refrigeration device; at least one active refrigeration unit including a set of evaporator coils, the evaporator coils positioned within an interior of the liquid-impermeable container; a sensor positioned within the liquid-impermeable container between the one or more walls and the set of evaporator coils; one or more walls substantially forming a storage region; a heat transfer system including a first group of vapor-impermeable structures with a hollow interior connected to form a condenser in thermal contact with the one or more walls substantially forming a liquid-impermeable container, a second group of vapor-impermeable structures with a hollow interior connected to form an evaporator in thermal contact with the one or more walls substantially forming a storage region, and a connector affixed to both the condenser and the evaporator, the connector forming a liquid and vapor flow path between the hollow interior of the condenser and the hollow interior of the evaporator; and a controller operably attached to the at least one active refrigeration unit and to the sensor.

In some embodiments, a refrigeration device includes: one or more walls substantially forming a first liquid-impermeable container, the first container configured to hold a first phase change material internal to a refrigeration device, wherein the one or more walls integrally include a first group of vapor-impermeable structures with a hollow interior connected to form a condenser; one or more walls substantially forming a storage region and integrally including a second group of vapor-impermeable structures with a hollow interior connected to form an evaporator; a connector affixed to both the condenser and the evaporator, the connector forming a liquid and vapor flow path between the hollow interior of the condenser and the hollow interior of the evaporator, wherein the condenser, the evaporator and the connector form a heat transfer system integral to the refrigeration device positioned between the first liquid-impermeable container and the storage region; one or more walls substantially forming a second liquid-impermeable container, the second container configured to hold a second phase change material internal to the refrigeration device; a storage unit for removable cold packs positioned in thermal contact with the second liquid-impermeable container; and at least one active refrigeration unit including a set of evaporator coils, the evaporator coils including a first section positioned within an interior of the first liquid-impermeable container, a second section positioned between the first liquid-impermeable container and the second liquid-impermeable container, and a third section positioned within an interior of the second liquid-impermeable container.

Some embodiments further include a fan of a size, shape and position to promote airflow along the second section of the evaporator coils and the storage unit for removable cold packs. In some embodiments, a fan is operably connected to a power controller. In some embodiments, the storage unit includes a framework of a size, shape and position to maximize thermal transfer between the storage unit for removable cold packs and the second liquid-impermeable container. A framework may, for example, be of a size, shape and position to secure a face of a cold pack against the framework in a position to enhance thermal transfer. A framework may, for example, be of a size, shape and position to secure a cold pack in a position for the fan to circulate air between the cold pack and a surface of the second liquid-impermeable container.

In some embodiments, the storage unit includes one or more partitions of a size, shape and position to secure one or more cold packs. The cold pack may include, for example, reusable ice packs. The cold pack may include, for example, removable phase change material (PCM) packs of a size and shape for use in portable cold chain devices, such as coolers or medical supply transporters. For example, the PCM may include one or more of water and/or ice. In some embodiments the PCM may include water and/or ice including at least one salt. For example, the PCM may include one or more of oil-based phase change materials. For example, the PCM may include one or more of synthetic phase change materials. In some embodiments the cold packs contain a PCM with a freeze point around 2 degrees C. to around 8 degrees C. In some embodiments the cold packs contain a PCM with a freeze point around 2 degrees C. to around 5 degrees C. In some embodiments the storage unit is configured to reach a minimum temperature around 0 degree C., around −1 degree C., or around −2 degree C. In some embodiments, the PCM includes tetradecane. In some embodiments, the PCM includes methyl laurate.

In some embodiments, a valve is operably attached to the second section of the evaporator coils, the valve of a type and positioned to divert refrigerant within the evaporator coils to the first section or the third section of the evaporator coils to a greater or lesser degree. In some embodiments, the valve is a solenoid valve. In some embodiments the valve is attached to a control system to reversibly control the valve operation. The control system may, for example, open and close the valve in response to information such as the historic power availability, system temperatures, day of the week, the external temperature, the time of day, expected weather patterns, and/or user input. In some embodiments the control system includes logic and circuitry including parameters to control the valve based on external information.

In some embodiments, a freezer accessory to a refrigeration device includes: one or more walls substantially forming a liquid-impermeable container, the container configured to hold phase change material internal to the accessory, wherein the one or more walls integrally include a first group of vapor-impermeable structures with a hollow interior connected to form a condenser; at least one active freezer unit including a set of evaporator coils, the evaporator coils positioned within an interior of the liquid-impermeable container; one or more walls substantially forming a storage region and integrally including a second group of vapor-impermeable structures with a hollow interior connected to form a evaporator; a connector affixed to both the condenser and the evaporator, the connector forming a liquid and vapor flow path between the hollow interior of the condenser and the hollow interior of the evaporator, wherein the condenser, the evaporator and the connector form a heat transfer system integral to the freezer accessory; and an electronic connection of a size, shape and position to attach the freezer accessory to a refrigeration device.

In some embodiments, the electronic connection includes a power cable configured to permit the freezer accessory to draw electrical power from the refrigeration device. In some embodiments, the electronic connection includes a data cable configured to permit the refrigeration accessory to transfer data to, and accept data from, the refrigeration device. In some embodiments, the electronic connection includes a control cable configured to permit the freezer accessory to accept control signals from a refrigeration device. In some embodiments, the electronic connection includes a control cable configured to permit the freezer accessory to send control signals to a refrigeration device.

In some embodiments, a refrigeration device includes: a thermal transfer unit including a set of hollow tubes forming an evaporative region, a set of hollow tubes forming a condensing region, and one or more hollow tubes forming an adiabatic region connecting the evaporative region and the condensing region, wherein the hollow tubes are sealed to each other to form a contiguous interior region; one or more reversible valves operably attached to the one or more hollow tubes forming the adiabatic region; a container with one or more walls sealed to hold a quantity of phase change material (PCM), the one or more walls including an aperture sealed around a set of refrigeration coils and wherein the condensing region of the thermal transfer unit is in thermal contact with the one or more walls; and a controller operably connected to the one or more reversible valves and the refrigeration compressor unit.

FIG. 1 depicts an external view of a refrigeration device 100. The refrigeration device 100 includes outer walls 105 and a door 110. The door 110 can be opened and closed to access the interior storage region of the refrigeration device 100. A handle 115 affixed to the door 110 can be used to pull open the door 110 and to close it after accessing the interior storage region. An electrical cord 120 is connected to a power source, such as an electrical outlet, a battery unit, or a solar array. For example a solar array can include a solar photovoltaic (PV) array.

Figure 2:
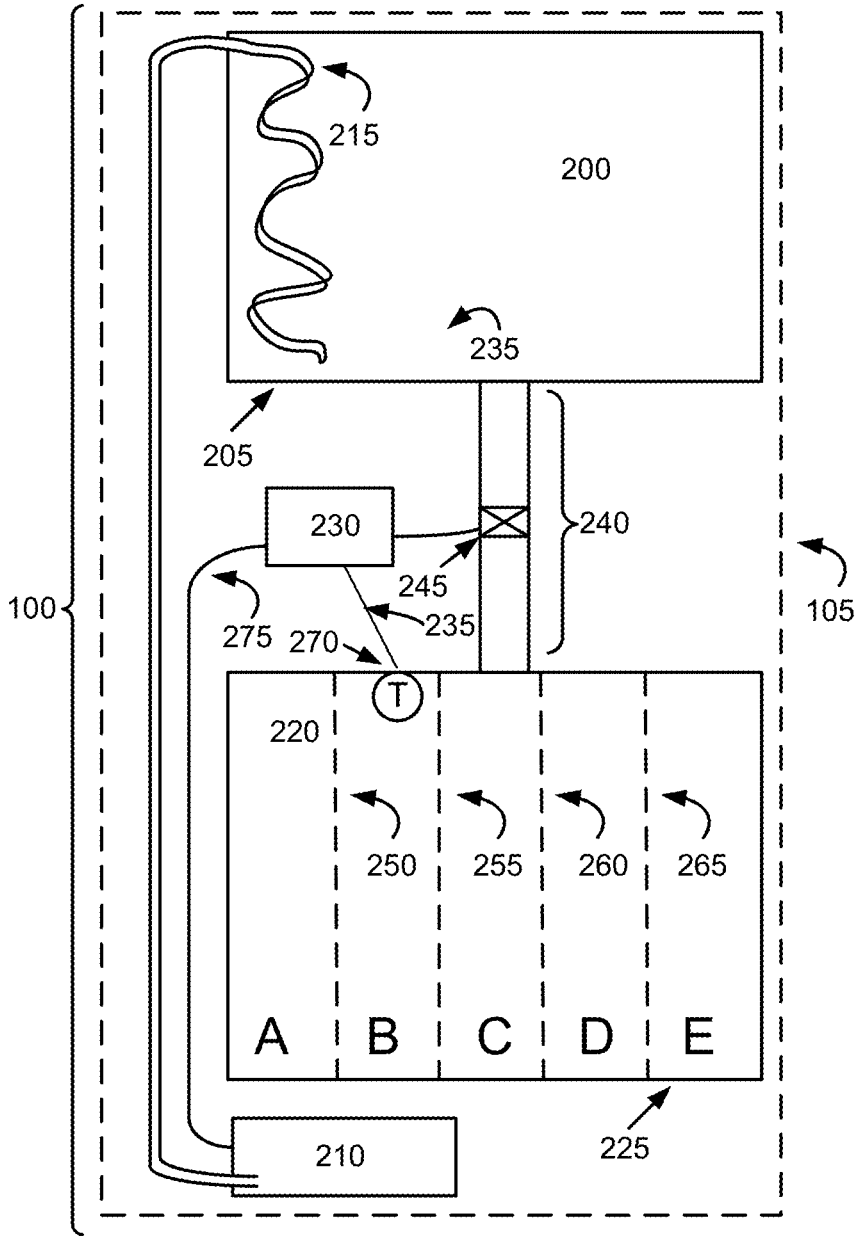
FIG. 2 is a schematic of aspects of a refrigeration device.

FIG. 2 depicts aspects of the interior structures of a refrigeration device 100. The refrigeration device 100 includes an interior container 200 formed by walls 205. The container 200 includes one or more walls 205 sealed to hold a quantity of phase change material (PCM), the one or more walls 205 including an aperture sealed around a set of refrigeration coils 215 and wherein the condensing region of the thermal transfer unit is in thermal contact with the one or more walls 205. The interior container is of a size and shape to hold a suitable quantity of PCM for a given embodiment. Different volumes of PCM will be required in different embodiments depending on the type of PCM utilized and the expected use case. The size, shape and position of the container in a given embodiment also positions one or more surfaces of the container in thermal contact with the condensing region of the thermal transfer unit. In some embodiments, the one or more walls of the interior container are sealed to each other to hold PCM within the container without leakage. The one or more walls of the interior container can be sealed to each other with liquid-tight or similarly formed seals, for example. The seals can be fabricated from a material that is expected to be non-reactive with a specific PCM used, for example a seal that is durable in the presence of an oil-based PCM or not expected to corrode in the presence of a PCM containing salt.

The refrigeration device 100 includes a refrigeration compressor unit 210. The refrigeration compressor unit can be of a standard type used in refrigerators and freezers. The refrigeration compressor unit can be a binary function (on/off) unit, for example. The refrigeration compressor unit can be a variable speed unit, for example one with power needs within an expected range of available power from a solar panel array. The refrigeration compressor unit 210 includes at least one set of refrigeration coils 215. The set of refrigeration coils 215 pass through the interior of the refrigeration device 100 and are positioned to traverse the one or more walls 205 of the interior container 200. When in use, the set of refrigeration coils 215 within the container 200 are in contact with the PCM within the container 200.

A storage region 220 includes one or more walls 225 substantially forming the storage region 220 within the refrigeration device 100. For example, the storage region 220 can be formed by a plurality of walls 225 positioned and joined together at their edges to form a rectangular or box-like structure. The storage region 220 is of a size and shape to hold one or more cold packs within the storage region 220 while the refrigeration device 100 is in use. A door is positioned adjacent to the storage region to provide access to the interior of the storage region. In some embodiments, the container 200 is positioned above the storage region 220 when the refrigeration device 100 is in an orientation for intended use. Some embodiments include a drain connected to the storage region 220, the drain of a size, shape and position to permit flow of liquid within the storage region 220. For example a drain can be configured to permit condensed water to drain away from the interior of the storage region.

Some embodiments include at least one temperature sensor positioned within the storage region. In the embodiment illustrated in FIG. 1, there is a temperature sensor 270 positioned within the storage region 220. The temperature sensor is connected to the controller 230 with a wire connector 235. The temperature sensor is of a type and is affixed within the storage region in a position to provide temperature information about the interior storage region. Information from one or more sensors can be utilized, for example, to inform logic within an attached controller as to when the reversible valve should be opened or closed. In some embodiments, a temperature sensor is of a type and is affixed within the storage region in a position to provide temperature information about one or more adjacent cold packs positioned within the storage region. For example, a temperature sensor can be of a type and affixed within the storage region in a position to provide temperature information about one or more adjacent cold packs. Information from one or more sensors can be utilized, for example, to indicate to a user when the cold packs are sufficiently equilibrated within the predetermined temperature range for use.

In the embodiment illustrated, the storage region 220 includes optional partitions 250, 255, 260, 265 positioned within the storage region 220. Some embodiments include one or more partitions of a size, shape and position to hold a number of cold packs within the storage region. The plurality of partitions 250, 255, 260, 265 are collectively referred to as the 'partitions' herein. In the embodiment illustrated, there are four partitions which, in combination with the walls 225 of the storage region 220, form five regions of the storage region (regions A, B, C, D, E). Each region is of a size, shape and position to hold at least one cold pack during chilling and storage within the refrigeration device. The number of region in a given embodiment depends on factors such as the size and shape of the storage region, the size and shape of the cold pack(s) intended for use, and the size and shape of the partition(s). Partitions can be affixed to a wall forming the storage region and/or affixed within a framework for support. Some embodiments include a sensor in a partition, the sensor positioned to detect an adjacent cold pack. For example, a partition can include a temperature sensor positioned to detect the temperature of an adjacent cold pack within the partition space. For example, a partition can include a pressure sensor oriented to detect physical pressure from an adjacent cold pack placed within the partition space. For example, a partition can include a RFID sensor of a type to detect a passive RFID tag affixed to an adjacent cold pack.

The refrigeration device includes a thermal transfer unit. The thermal transfer unit includes a set of hollow tubes forming an evaporative region, a set of hollow tubes forming a condensing region, and one or more hollow tubes forming an adiabatic region connecting the evaporative region and the condensing region, wherein the hollow tubes are sealed to each other to form a contiguous interior region. In some embodiments, the thermal transfer unit is a thermosiphon. In some embodiments, the contiguous interior region of the thermal transfer unit includes a gas pressure less than ambient pressure and a refrigeration fluid. In some embodiments, the contiguous interior region of the thermal transfer unit includes a gas pressure greater than ambient pressure and a refrigeration fluid. For example, the gas pressure inside the sealed interior of the thermal transfer unit can be in the range of 15 atmospheres (atm) of pressure to 20 atmospheres of pressure. For example, the refrigeration liquid could include one or more of r134a, r1234yf, r600a, and/or r404a. The tubes of the thermal transfer unit are fabricated from a thermally-conductive material, for example a copper or aluminum alloy. In some embodiments, the thermal transfer unit is fabricated from a roll-bond manufactured material. The hollow tubes forming the thermal transfer unit are contiguous and sealed from the external atmosphere. The gas pressure within the thermal transfer device is below ambient atmospheric pressure. In some embodiments, a non-condensable gas, such as nitrogen, is added to the interior of the interior of the thermal transfer unit before the hollow tubes are sealed. A refrigeration fluid is present within the hollow tubes of the thermal transfer unit. In the view of FIG. 2, only the adiabatic region 240 of the thermal transfer unit is visible.

The evaporative region of the thermal transfer unit is in thermal contact with the one or more walls 225 of the storage region 220. The thermal contact can be, for example, through direct contact or with a thermally conductive material placed between the walls 225 of the storage region 220 and the evaporative region of the thermal transfer unit.

The condensing region of the thermal transfer unit is in thermal contact with the one or more walls 205 of the container 200 containing PCM. The thermal contact can be, for example, through direct contact or with a thermally conductive material placed between the walls 205 of the container 200 and the condensing region of the thermal transfer unit.

A refrigeration device 100 includes a reversible valve 245 operably connected to the adiabatic region 240 of the thermal transfer device. The reversible valve can be, for example, a valve that includes an open and closed configuration. The reversible valve can be, for example, a valve that includes open, closed and intermediate positions. The reversible valve can be, for example, a ball valve, a solenoid valve, or a butterfly valve. Some embodiments include a single valve operably connected to the adiabatic region of the thermal transfer device. Some embodiments include a series of valves operably connected to the adiabatic region of the thermal transfer device. A valve can be reversibly controllable, for example with a motor or mechanism to reversibly open and close the valve.

The refrigeration device 100 includes a controller 230. The controller 230 is operably connected to the reversible valve 245 and the refrigeration compressor unit 210. The controller includes hardware and/or firmware to receive information from the reversible valve and the refrigeration compressor unit, for example information about status (e.g. open/closed valve and/or on/off compressor unit). The controller is operably attached to the temperature sensor(s), and configured to accept information from the temperature sensor(s). The controller includes hardware and/or firmware to receive information from the reversible valve and/or the refrigeration compressor unit, and to provide corresponding signals to the reversible valve and/or the refrigeration compressor unit in response to the received information. For example, if the controller receives information that refrigeration compressor unit is not active or not turned on, the controller may send a signal to the reversible valve to open. The controller includes hardware and/or firmware to receive information from the temperature sensor, and to provide corresponding signals to the reversible valve and/or the refrigeration compressor unit in response to the received information. For example, if the received information from the temperature sensor in the storage region indicates a temperature that is above a predetermined maximum temperature, the controller may send a signal to the reversible valve to open the valve and permit more refrigerant through the adiabatic region. Some embodiments include a temperature sensor positioned within the storage region, the temperature sensor operably connected to the controller. Some embodiments include a temperature sensor affixed to the container and operably connected to the controller. For example, a temperature sensor can be positioned inside of a container in a location where it will be in contact with the PCM during use.

Figure 3:
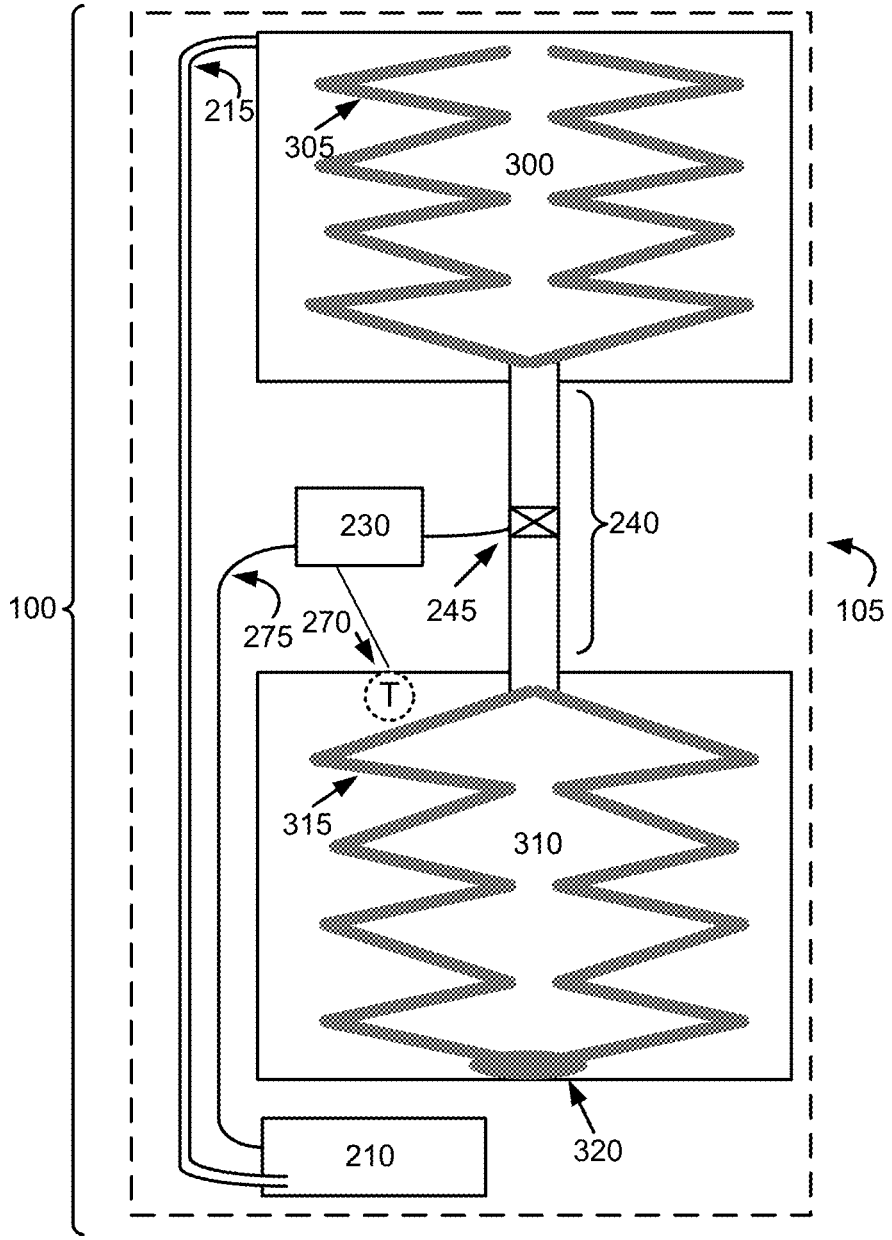
FIG. 3 is a schematic of aspects of a refrigeration device.

FIG. 3 depicts a view of some interior structures of a refrigeration device. The refrigeration device 100 includes an outer wall 105. Within the outer wall 105 is a thermal transfer unit including a set of hollow tubes 315 forming an evaporative region 310, a set of hollow tubes 305 forming a condensing region 300, and a hollow tube forming an adiabatic region 240 connecting the evaporative region 310 and the condensing region 300. The hollow tubes 315, 305, 245 are sealed to each other to form a contiguous interior region of the thermal transfer unit. The thermal transfer unit also includes a reservoir 320 for refrigeration fluid positioned at a low position within the evaporative region 310 of the thermal transfer unit. A temperature sensor 270 is positioned within the storage region adjacent to the evaporative region 310. The temperature sensor 270 is operably connected to a controller 230.

During use, the refrigeration fluid within the thermal transfer unit circulates within the contiguous interior region of the thermal transfer unit. A refrigeration fluid is selected based on factors including its thermal properties within the device design, including the thermal properties and evaporation temperature in the reduced gas pressure within the sealed contiguous interior region of the thermal transfer unit, cost, and durability. During use, the refrigeration liquid evaporates within the evaporative region 310 at a rate relative to the temperature of the adjacent storage region. The vapor refrigerant rises through the evaporative region 310 and the adiabatic region 240 into the condensing region 300. The refrigeration liquid vapor then condenses in the condensing region 300 at a rate relative to the temperature of the adjacent container with PCM. The condensed refrigeration liquid then falls through the adiabatic region 240 to the lowest point in the system, the reservoir 320 of the evaporative region 310. Opening and closing of the valve 245 operably attached to the adiabatic region 240 controls the rate of flow of the refrigerant liquid and vapor within the thermal transfer unit, and thereby the rate of heat transfer between the storage region and the container. Control of the valve opening and closing by the controller can therefore maintain the storage region in the temperature range needed for bringing cold packs to within a temperature range required for storage of a particular medicinal material or set of medicinal materials.

Figure 4:
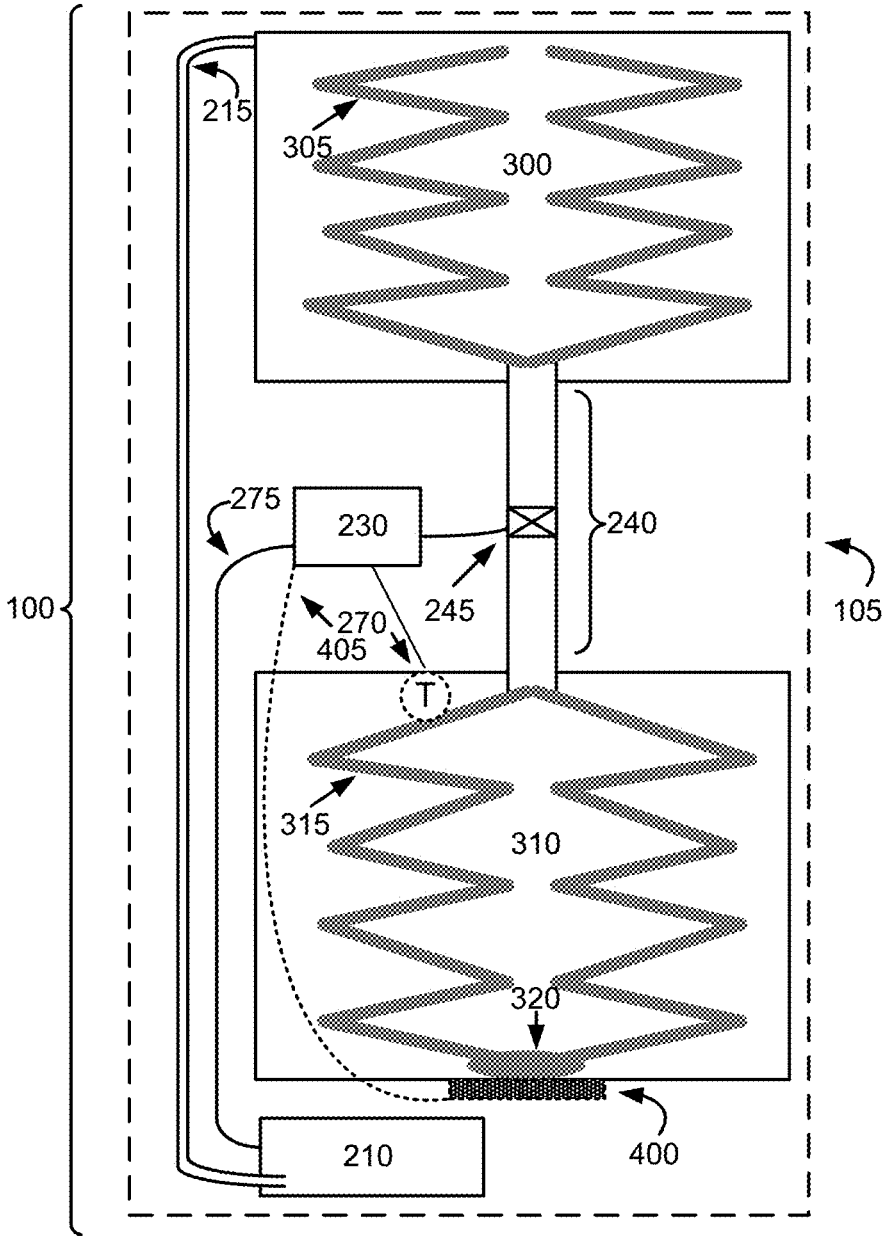
FIG. 4 is a schematic of aspects of a refrigeration device.

FIG. 4 depicts aspects of a refrigeration device 100. The embodiment includes an evaporative region 310 of the thermal transfer unit, with a reservoir 320 for refrigeration fluid positioned at a low position within the evaporative region 310. A heater 400 is positioned adjacent to the reservoir 320. The heater 400 is of a size, shape, type and position to warm the refrigeration fluid within the reservoir 320 and, thereby, provide additional control over the temperature of the adjacent storage region. The heater can be, for example, a set of low power electric heating coils. The heater 400 is operably connected to the controller 230 with a wire connector 405. The controller 230 can, for example, be configured to reversibly close the valve 245 when the heater 400 is operational to maintain heat within the reservoir 320 and adjacent regions of the thermal transfer unit and storage region. Some embodiments include a reservoir for refrigeration fluid positioned at a low position within the evaporative region of the thermal transfer unit; and a heater affixed to the reservoir, the heater operably connected to the controller. Some embodiments include a drain connected to the storage region, the drain of a size, shape and position to permit flow of liquid within the storage region. For example, a drain may be positioned to remove condensate or liquid created during a defrost cycle from the storage region.

Embodiments with heaters can be utilized to maintain the temperature of the storage region above a minimum temperature. For example, in some use situations the ambient temperature around the refrigeration device can be below the lowest temperature of the predetermined temperature range of the storage region. For example, in some use situations frost may begin to form on the interior surface of the storage region and warming the surface would assist in removing the ice. In response to signals sent by the controller, the heater can be turned on briefly to maintain a minimum temperature within the storage region. When a temperature sensor affixed to the storage region sends information to the controller that the temperature of the storage region is above a minimum, the controller can include hardware and/or firmware that generates a response resulting in the heater being turned off.

Figure 5:
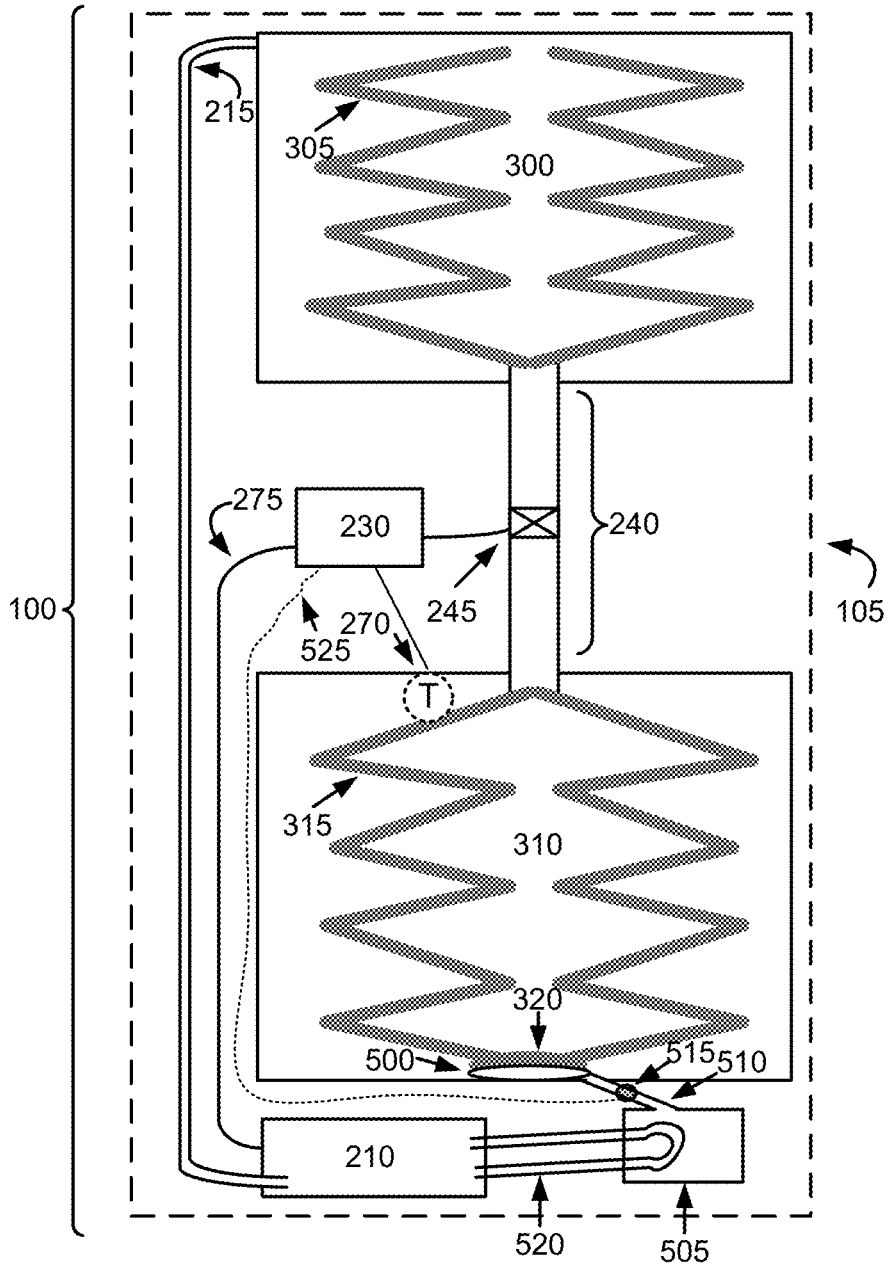
FIG. 5 is a schematic of aspects of a refrigeration device.

FIG. 5 illustrates aspects of a refrigeration device 100. The refrigeration device 100 includes a thermal transfer unit, with a reservoir 320 within the evaporative region 310. The device 100 includes a refrigeration compressor unit 210 including a set of refrigeration coils 215 that traverse the walls of the container to contact the PCM within the container. The refrigeration compressor unit 210 also includes a second set of coils 520 which extend from the refrigeration compressor unit 210 through the walls of a second container 505 containing a second PCM. In some embodiments, the first set of coils are refrigeration coils and the second set of coils are condenser coils. A reservoir 500 of the second PCM is positioned adjacent to the reservoir 320 within the evaporative region 310, so that the reservoirs 320, 500 are in thermal contact with each other. A connector 510 forms a conduit between the reservoir of the second PCM and the second container 505. A reversible valve 515 is operably connected to the connector 510. The reversible valve 515 is connected to the controller 230 with a wire 525.

During use, and embodiment with features such as illustrated in FIG. 5 can be utilized to maintain a minimum temperature within the storage region. The second PCM within the second container can be warmed by condenser coils from the refrigeration compressor unit. When the valve is opened to permit the second PCM to circulate between the second container and the interior of the reservoir of the second PCM, the refrigerant liquid in the refrigerant liquid reservoir is warmed. The reversible valve operably attached to the conduit between the second container and the PCM reservoir can be reversibly opened and closed by the controller in response to information from a temperature sensor affixed to the storage region.

Some embodiments include: a reservoir for refrigeration fluid positioned at a low position within the evaporative region of the thermal transfer unit; a thermal conduit positioned between the reservoir and an exterior region of the refrigeration device; and a reversible valve operably connected to the thermal conduit, the reversible valve operably connected to the controller. Such an embodiment can be used to equilibrate the temperature of the refrigerant liquid within the reservoir through air circulation with external ambient air. For example, the valve can be opened in response to the controller on a predefined schedule and/or in response to a low temperature value from a temperature sensor attached to the storage region. Such a system can, for example, reduce the possibility of frost within the storage region and cooling for the storage region below a predetermined minimum temperature.

Figure 6:
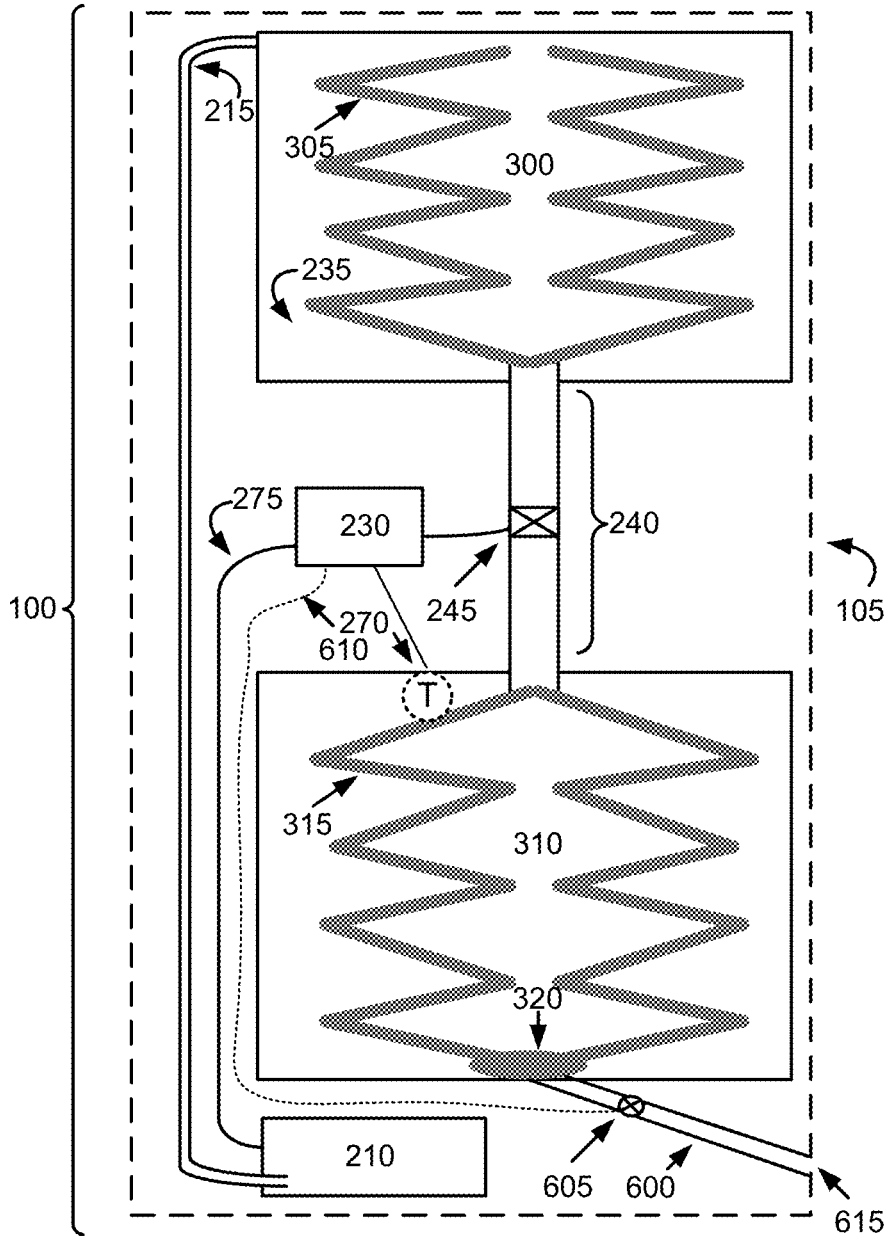
FIG. 6 is a schematic of aspects of a refrigeration device.

FIG. 6 illustrates aspects of an embodiment of a refrigeration device 100. The device 100 includes a thermal transfer unit, with a reservoir 320 within the evaporative region 310. A conduit 600 has a first end positioned adjacent to the surface of the reservoir 320 and the second end adjacent to an aperture 615 in the wall 105 of the refrigeration device 100. The conduit 600 forms an air flow pathway between ambient air adjacent to the device and a surface region of the reservoir 320 within the evaporative region 310. A reversibly controllable valve 605 is operably attached to the conduit 600. The reversibly controllable valve 605 is controlled by signals from the controller 230 via a wire connection 610.

Some embodiments of a refrigeration device include one or more thermal transfer devices positioned within an interior of the container, the one or more thermal transfer devices in thermal contact with the condensing region of the thermal transfer unit. For example, a thermal transfer device can be formed as a set of fin structures thermally connecting the condensing region of the thermal transfer unit with the PCM within the container.

Figure 7:
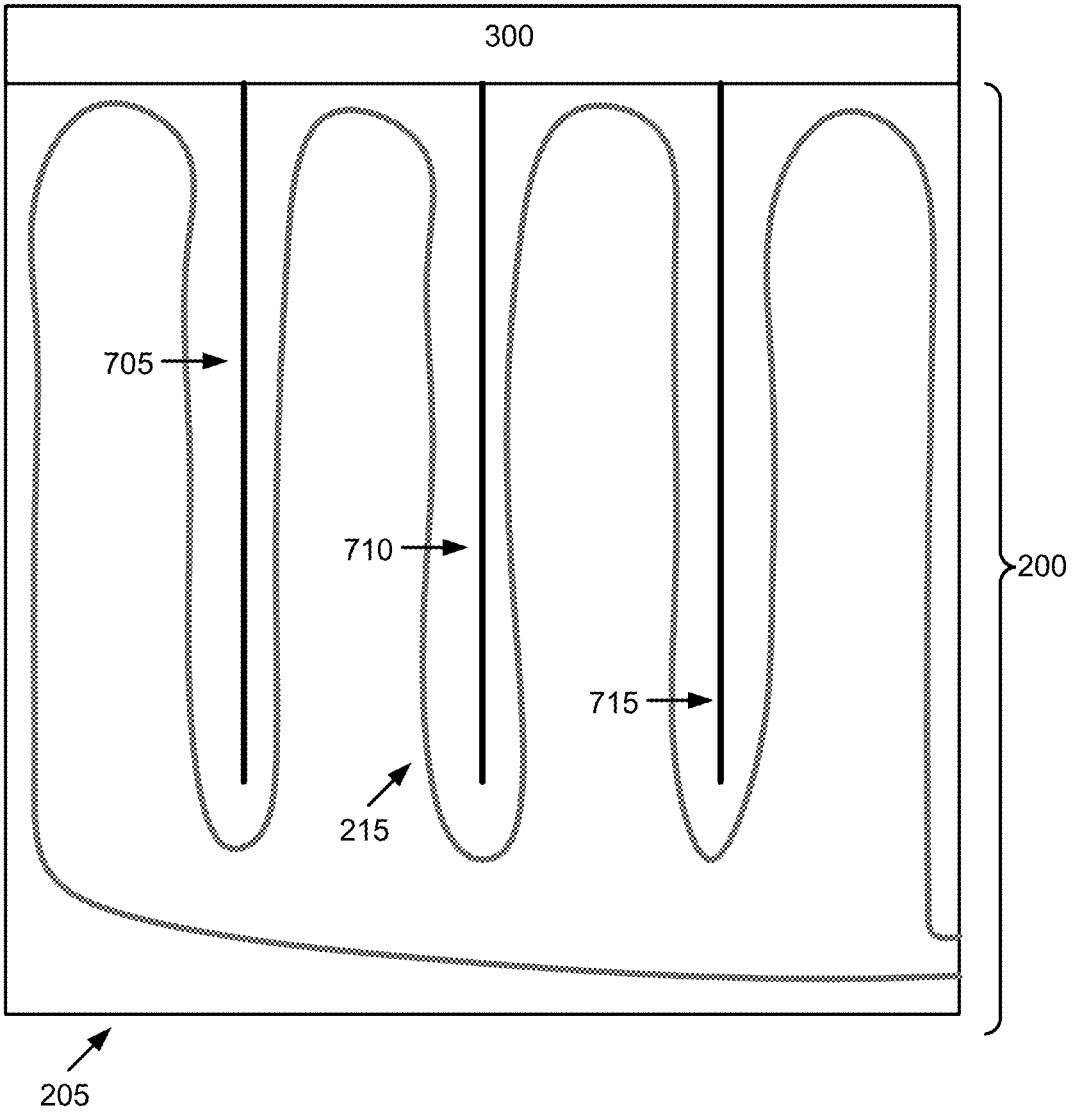
FIG. 7 is a schematic of aspects of a refrigeration device.

FIG. 7 depicts a view of a thermal transfer device positioned within the walls 205 of a container 200 within a refrigeration device. The view illustrated in FIG. 7 is a top down view relative to the view of FIGS. 1 through 6. The container 200 is has a wall 205 that is positioned adjacent to a condenser region 300 of a thermal transfer unit. The container 200 and the condenser region 300 are positioned and affixed to provide direct thermal transfer between the wall 205 of the container 200 and the condenser region 300. A set of fin structures 705, 710, 715 are affixed at a first end to the interior of the container 200 at a position adjacent to the condenser region 300. The fin structures are fabricated from a thermally conductive material, such as aluminum alloy or copper alloy. The fin structures 705, 710, 715 are fabricated from a material that is expected to be durable in contact with the PCM within the container 200. The fin structures 705, 710, 715 are of a size, shape and position to provide thermal conductivity between the condensing region 300 and the PCM within the container 200. Although three fin structures 705, 710, 715 are illustrated in the embodiment of FIG. 7, the configuration of a thermal transfer device can vary between embodiments based on factors such as the thermal conduction properties of the wall of the container, the thermal conduction properties of the PCM, the thermal conduction properties of the thermal transfer device, and the expected use case of the refrigeration device. For example, a thermal transfer device can include one or more of heat pipes, heat pipes containing wicks, and/or thermosiphons.

Some embodiments of a refrigeration device include: one or more partitions forming sections within the storage region, each section of a size, shape and position to a cold pack within the storage region; at least one temperature sensor affixed within each section, each temperature sensor positioned to detect temperature of the cold pack within the section; and at least one indicator positioned adjacent to each of the one or more sections, each indicator operably connected to the controller. Some embodiments also include at least one fan operably connected to the controller. The fan can be affixed within the storage region in a position to assist air movement throughout the storage region.

Figure 8:
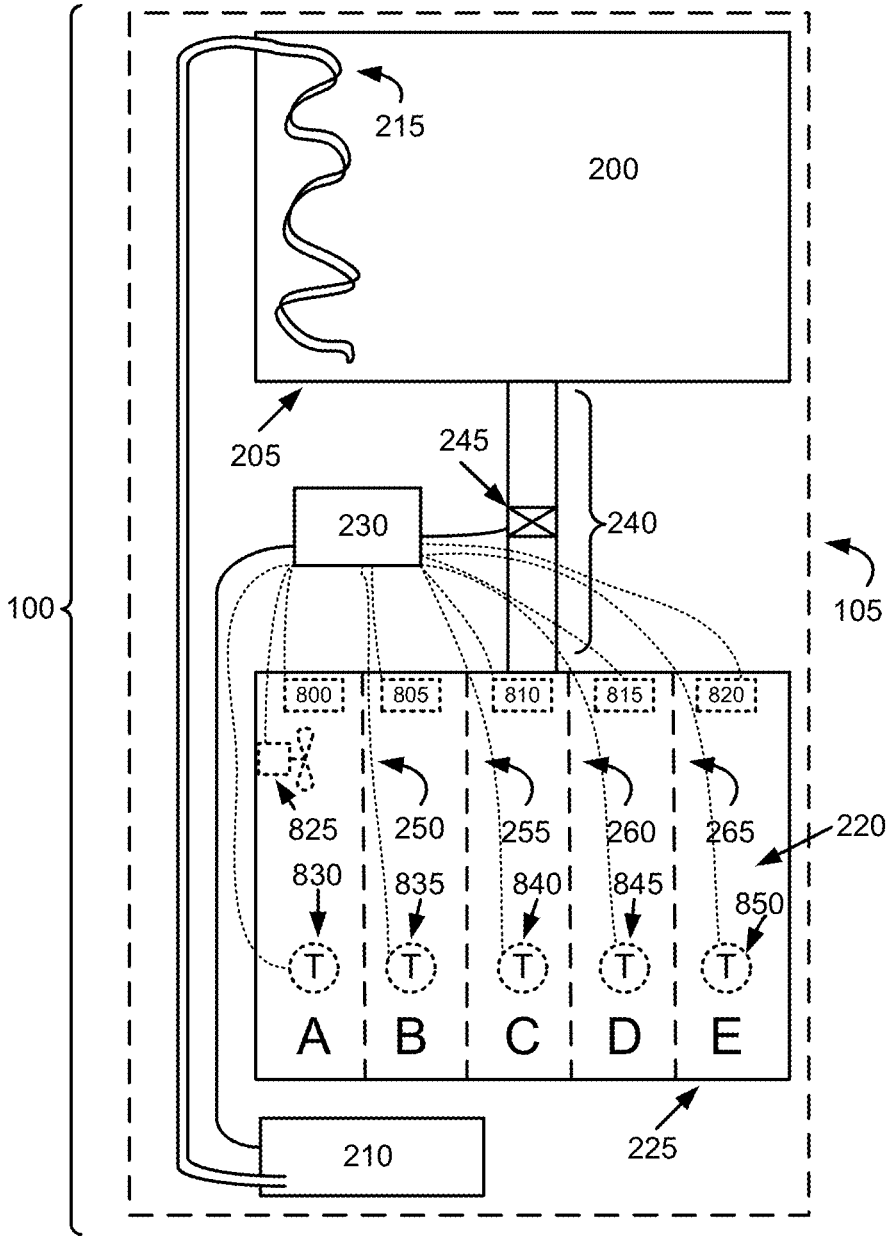
FIG. 8 is a schematic of aspects of a refrigeration device.

FIG. 8 depicts aspects of the interior of a refrigeration device 100. The refrigeration device 100 includes a container 200 with walls 205, the container configured to hold PCM. A set of refrigeration coils 215 from a refrigeration compressor unit 210 traverses the otherwise sealed walls 205 of the container 200. Below the container 200 is a storage region 220. The container 200 and the storage region 220 are thermally linked by a thermal transfer unit including an adiabatic region 240. Thermal transfer through refrigeration liquid and vapor within the thermal transfer unit is regulated by a controller 230 operating a reversible valve 245 operably attached to the adiabatic region 240.

The interior of the storage region 220 includes partitions 250, 255, 260, 265 affixed to the interior of the walls 225 of the storage region 220. Each of the partitions 250, 255, 260, 265 forms a region A, B, C, D, E of a size and shape to hold a single cold pack. Each of the regions A, B, C, D, E includes a temperature sensor 830, 835, 840, 845, 850 of a size, shape, type and position to measure the temperature of a surface of a cold pack placed within the region. Each of the temperature sensors 830, 835, 840, 845, 850 is connected to the controller 230 with a wire connection. Each of the temperature sensors 830, 835, 840, 845, 850 is configured to send information to the controller 230. In some embodiments, the temperature sensors are part of a sensor unit that includes a pressure sensor.

The controller includes hardware and/or firmware configured to receive information from the temperature sensors in each cold pack region of the storage region. The controller is also configured to accept information from other sensors that might be included in a sensor unit within the storage region. The controller is configured to accept the information from the sensors and compare it to preset standards for the cold packs. For example, a controller can contain hardware and/or firmware configured to compare the accepted temperature data, compare it to a temperature range, and send a signal in response to the comparison. A storage region 220 can include one or more indicators 800, 805, 810, 815, 820 positioned in a location where they are visible to a user of the refrigeration device 100 when the cold packs are in place within the storage region 220. For example, an indicator can include one or more small lights, such as LEDs. The LEDs can be illuminated by a signal sent by the controller in response to the information from the temperature sensors. In some embodiments, there are at least 2 LEDs of different colors within each indicator. For example an indicator can include both a red LED and a green LED, and the controller can be configured to send a signal to illuminate the red LED if the temperature information is not within an acceptable range, and correspondingly illuminate the green LED when the temperature information is within the acceptable range. Each region defined by a partition can include an indicator, wherein the controller is configured to send signals to the indicator in a region based on the accepted information from the temperature sensor within that region.

Some embodiments of a refrigeration device 100 include a fan 825 positioned within the storage region 220. A fan can be of a size, shape and position to circulate air within the storage region. The fan can be operably connected to the controller and be under the direct control of the controller. Some embodiments include multiple fans, for example a fan of a size, shape and position to circulate air around each of the cold packs positioned within the storage region.

In some embodiments, a refrigeration device includes: a first thermal transfer unit including a set of hollow tubes forming a first evaporative region, a set of hollow tubes forming a first condensing region, and one or more hollow tubes forming a first adiabatic region connecting the first evaporative region and the first condensing region, wherein the hollow tubes are sealed to each other to form a first contiguous interior region; at least one first reversible valve operably attached to the one or more hollow tubes forming the first adiabatic region; a first container with one or more walls sealed to hold a quantity of a first phase change material (PCM1), the one or more walls including an aperture sealed around a first set of refrigeration coils and wherein the first condensing region of the first thermal transfer unit is in thermal contact with the one or more walls; a second thermal transfer unit including a set of hollow tubes forming a second evaporative region, a set of hollow tubes forming a second condensing region, and one or more hollow tubes forming a second adiabatic region connecting the second evaporative region and the second condensing region, wherein the hollow tubes are sealed to each other to form a second contiguous interior region; at least one second reversible valve operably attached to the one or more hollow tubes forming the second adiabatic region; a second container with one or more walls sealed to hold a quantity of a second phase change material (PCM2), the one or more walls including an aperture sealed around a second set of refrigeration coils and wherein the second condensing region of the second thermal transfer unit is in thermal contact with the one or more walls; a refrigeration compressor unit including the first set of refrigeration coils, wherein the first set of refrigeration coils traverse the one or more walls of the first container, and the second set of refrigeration coils, wherein the second set of refrigeration coils traverse the one or more walls of the second container; a third reversible valve operably attached to the refrigeration compressor unit at a position to regulate flow through the first set of refrigeration coils and the second set of refrigeration coils, the third reversible valve operably attached to the controller; one or more walls forming a storage region, wherein the first evaporative region of the first thermal transfer unit and the second evaporative region of the second thermal transfer unit are thermal contact with the one or more walls; and a controller operably connected to the at least one first reversible valve, the at least one second reversible valve, and the refrigeration compressor unit.

Figure 9:
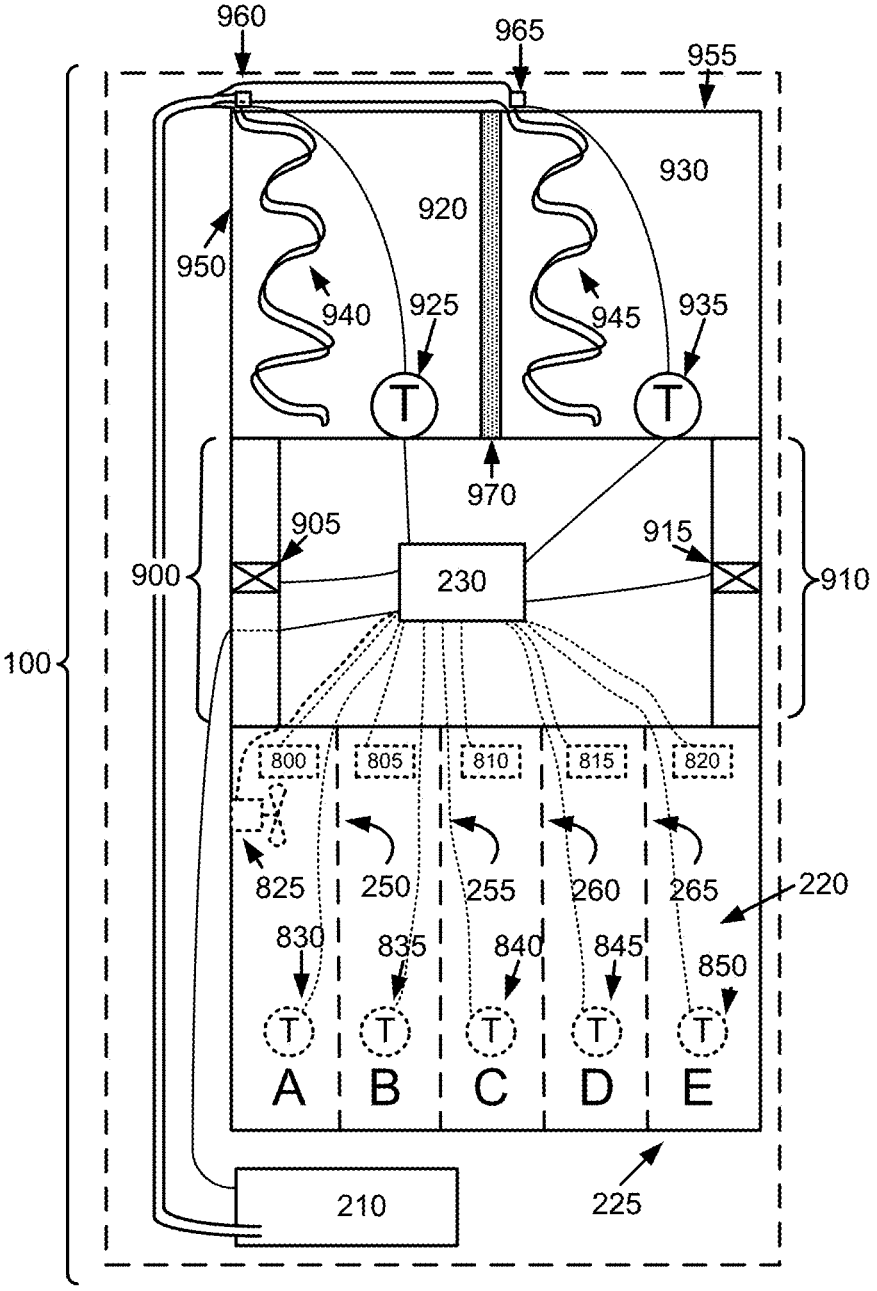
FIG. 9 is a schematic of aspects of a refrigeration device.

FIG. 9 depicts aspects of a refrigeration device 100 including a first container 920 and a second container 930, each of the containers 920, 930 of a size, shape and configuration to hold a PCM. The first container 920 is formed from walls 950 and is configured to hold a first PCM. The second container 930 is formed from walls 955 and is configured to hold a second PCM. A first temperature sensor 925 is positioned within the first container 920, the first temperature sensor 925 operably attached to the controller 230. A second temperature sensor 935 is positioned within the second container 930, the second temperature sensor 935 operably attached to the controller 230. A section 970 including insulation material is positioned between the first container 920 and the second container 930. The refrigeration device 100 includes a refrigeration compressor unit 210 with a first set of refrigeration coils 940 positioned within the first container 920. A second set of refrigeration coils 945 is positioned within the second container 930. A first valve 960 is operably connected to the first set of refrigeration coils 940, the valve is a reversible valve configured to operate under control of the controller 230. A second valve 965 is operably connected to the second set of refrigeration coils 945, the valve is a reversible valve configured to operate under control of the controller 230.

A first thermal transfer unit includes a condensing region in thermal contact with the walls 950 of the first container 920. A first adiabatic region 900 of the first thermal transfer unit has an operably attached first reversible valve 905. In some embodiments, the first reversible valve includes open, closed and intermediate positions. The first reversible valve is under the control of the controller 230. The first thermal transfer unit includes an evaporative region in thermal contact with the storage region 220 of the refrigeration device 100. In some embodiments, the first thermal transfer unit includes a thermosiphon. In some embodiments, the contiguous interior region of the first thermal transfer unit includes: a gas pressure less than ambient pressure; and a refrigeration fluid.

A second thermal transfer unit includes a condensing region in thermal contact with the walls 955 of the second container 930. A second adiabatic region 910 of the second thermal transfer unit has an operably attached second reversible valve 915. In some embodiments, the second reversible valve includes open, closed and intermediate positions. The second reversible valve is under the control of the controller 230. The second thermal transfer unit includes an evaporative region in thermal contact with the storage region 220 of the refrigeration device 100. In some embodiments, the contiguous interior region of the second thermal transfer unit includes: a gas pressure less than ambient pressure; and a refrigeration fluid. In some embodiments, the second thermal transfer unit includes a thermosiphon. In some embodiments, the first and second thermal transfer units are both thermosiphons, which can be integrated into a common fabricated section.

The storage region 220 is of a size, shape and position to hold a number of cold packs. In some embodiments, the storage region 220 includes partitions 250, 255, 260, 265 forming regions A, B, C, D, E within the storage region 220, wherein each region is of a size, shape and position to hold a cold pack. In some embodiments, each region includes a temperature sensor operably attached to the controller. In some embodiments, each region includes an indicator operably attached to the controller. In some embodiments, one or more fan is affixed to the interior of the storage region in a position to assist in air circulation through the storage region.

During use, an embodiment of a refrigeration device as illustrated in FIG. 9 can be utilized to extend refrigeration to the storage region through use of a first PCM with a first melting temperature in the first container, and a second PCM with a second melting temperature in the second container. The controller can reversibly operate the first valve attached to the first set of refrigeration coils and the second valve attached to the second set of refrigeration coils to control the temperature of the first PCM and the second PCM. The temperature sensors within each of the first container and the second container provide temperature information of the first PCM and the second PCM to the controller. The controller includes hardware and/or firmware to reversibly open and close the first and second valves attached to the first and second refrigeration coils in response to the information from the temperature sensors to maintain preset temperatures of the PCM in both the first and second containers. The controller is also operably connected to the refrigeration compressor unit. The controller includes hardware and/or firmware to reversibly turn on and off the refrigeration compressor unit in response to information from the temperature sensors. In some embodiments the refrigeration compressor unit is a variable speed unit and the controller varies the speed of the unit.

Figure 10:
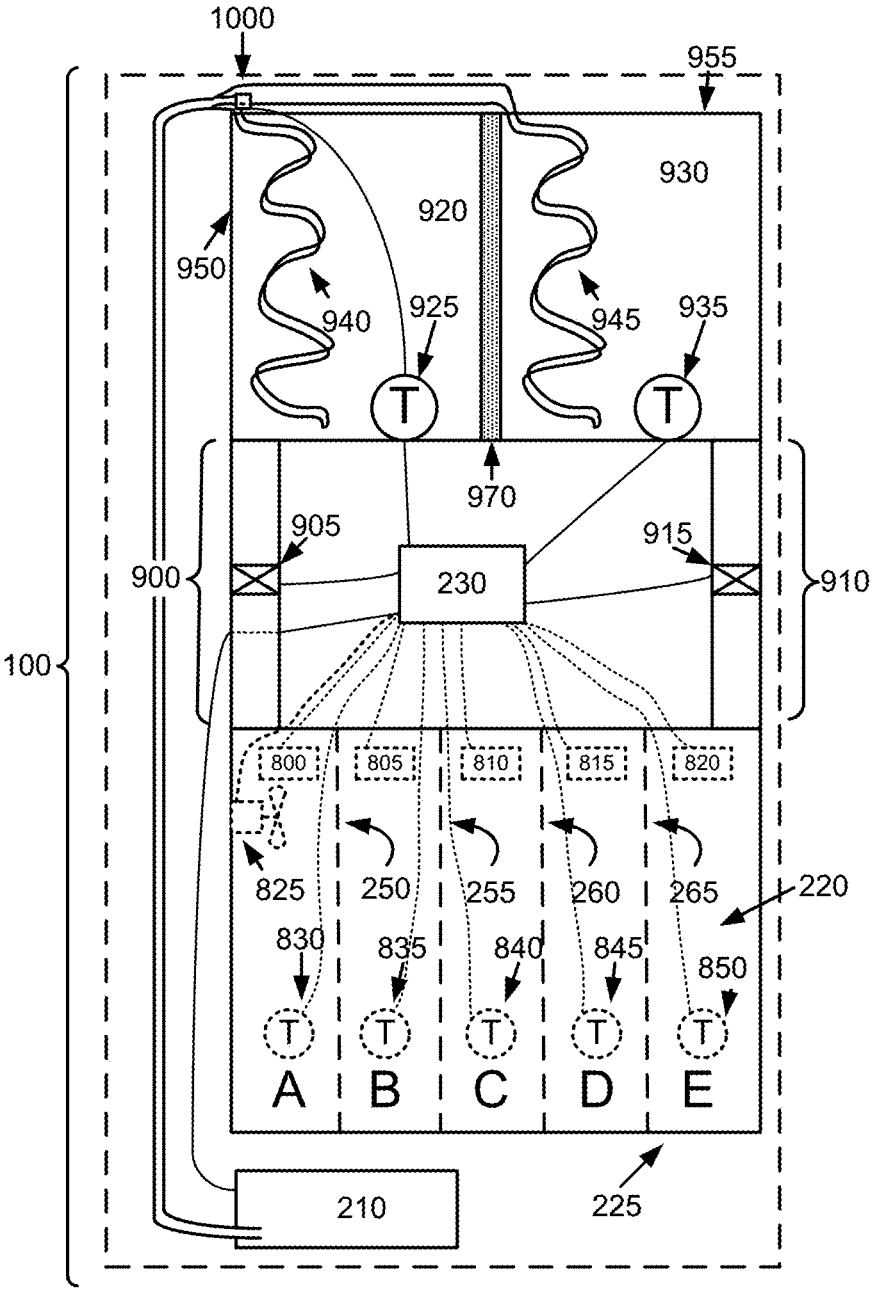
FIG. 10 is a schematic of aspects of a refrigeration device.

FIG. 10 depicts an embodiment of a refrigeration device 100 similar to the one depicted in FIG. 9, wherein there is a first reversible valve 1000 operably attached to the first set of refrigeration coils 940 within the first container 920. The second set of refrigeration coils 945 positioned within the second container 930 is part of a larger refrigeration loop as the first set of refrigeration coils 940. Operation of the first reversible valve 1000, therefore, controls the temperature of the first set of refrigeration coils 940 directly and also controls the temperature of the second set of refrigeration coils 945 indirectly.

Figure 11:
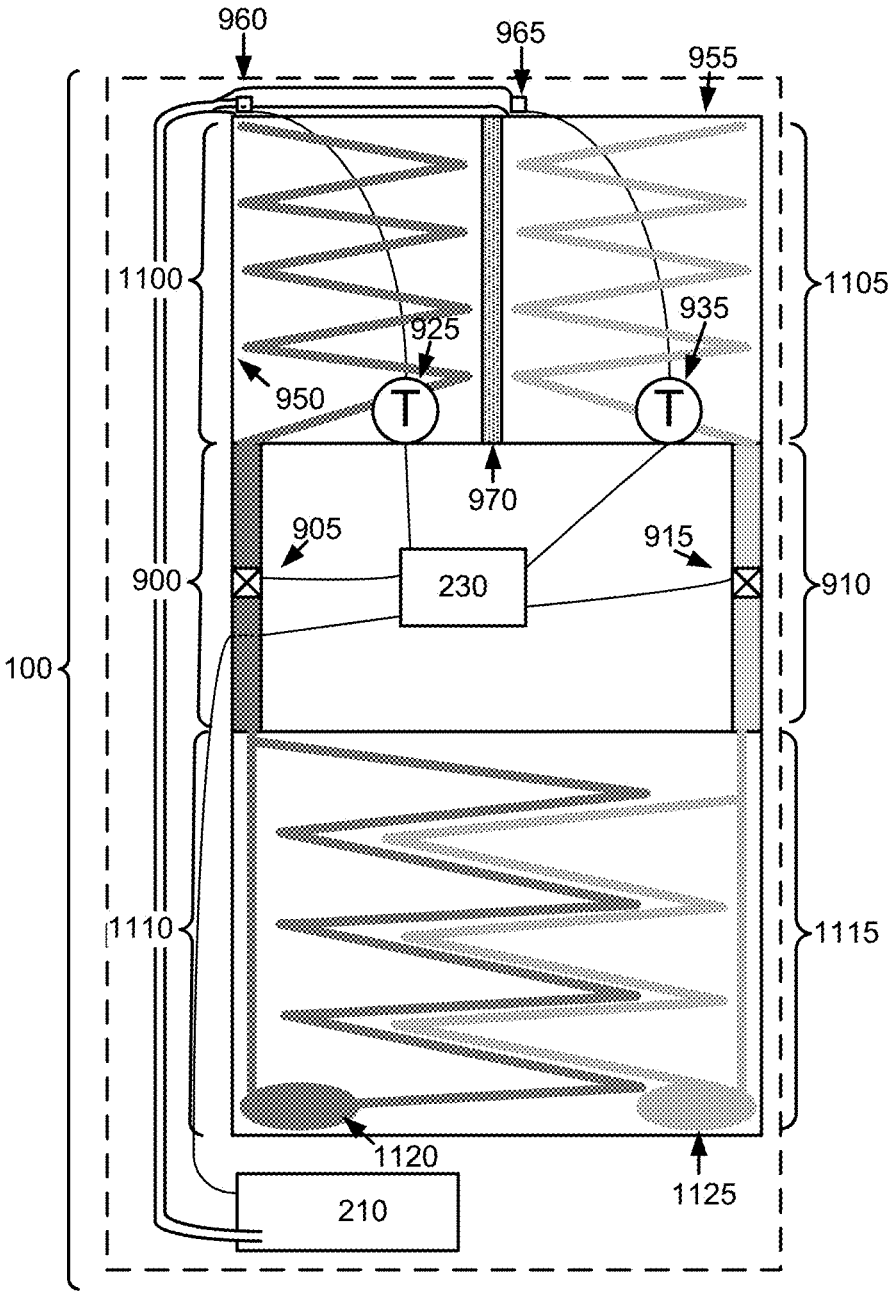
FIG. 11 is a schematic of aspects of a refrigeration device.

FIG. 11 depicts aspects of an embodiment of a refrigeration device 100 similar to the one depicted in FIG. 9. In the view of FIG. 11, aspects of the thermal transfer units are highlighted. A first condenser region 1100 is positioned adjacent to, and in thermal contact with, the first container. A second condenser region 1105 is positioned adjacent to, and in thermal contact with, the second container. Each condenser region 1100, 1105 is connected to an adjacent adiabatic region 900, 910. Each adiabatic region 900, 910 is connected to a evaporation region 1110, 1115. The first evaporation region 1110 includes a first refrigerant reservoir 1120. The second evaporation region 1115 includes a second refrigerant reservoir 1125. The first thermal transfer unit and the second thermal transfer unit each include a sealed interior region with a refrigerant liquid and a gas pressure less than the ambient air pressure. The refrigerant liquid within the first thermal transfer unit and the refrigerant liquid within the second thermal transfer unit can be the same type of refrigeration liquid. The refrigerant liquid within the first thermal transfer unit and the refrigerant liquid within the second thermal transfer unit can be the different types of refrigeration liquid. In some embodiments, the gas pressure within the first thermal transfer unit and the gas pressure within the second thermal transfer unit are set to the same reduced pressure at the time of manufacture of the device. In some embodiments, the gas pressure within the first thermal transfer unit and the gas pressure within the second thermal transfer unit are set to different reduced pressures at the time of manufacture of the device.

In some embodiments, the first evaporation region and the second evaporation region are positioned adjacent to each other on the same backing or support structure in thermal contact with the storage region. For example in the embodiment shown in FIG. 11, the first evaporation region 1110 and the second evaporation region 1115 each include portions that are positioned adjacent to each other. In some embodiments, the thermal transfer units are manufactured as a single roll-bond unit with two independent channels for the first evaporation region and the second evaporation region.

In some embodiments, a refrigeration device includes: a container with one or more walls sealed to hold a quantity of PCM; a refrigeration compressor unit including the set of refrigeration coils, wherein the set of refrigeration coils are in thermal contact with the PCM; one or more walls forming a storage region; a set of hollow tubes sealed to form a refrigerant loop with a first end of the refrigerant loop in thermal contact with the PCM and a second end of the refrigerant loop in thermal contact with the storage region; a pump operably connected to the refrigerant loop; and a controller operably connected to the pump. The refrigerant loop can be a sealed loop containing single-phase liquid coolant.

Figure 12:
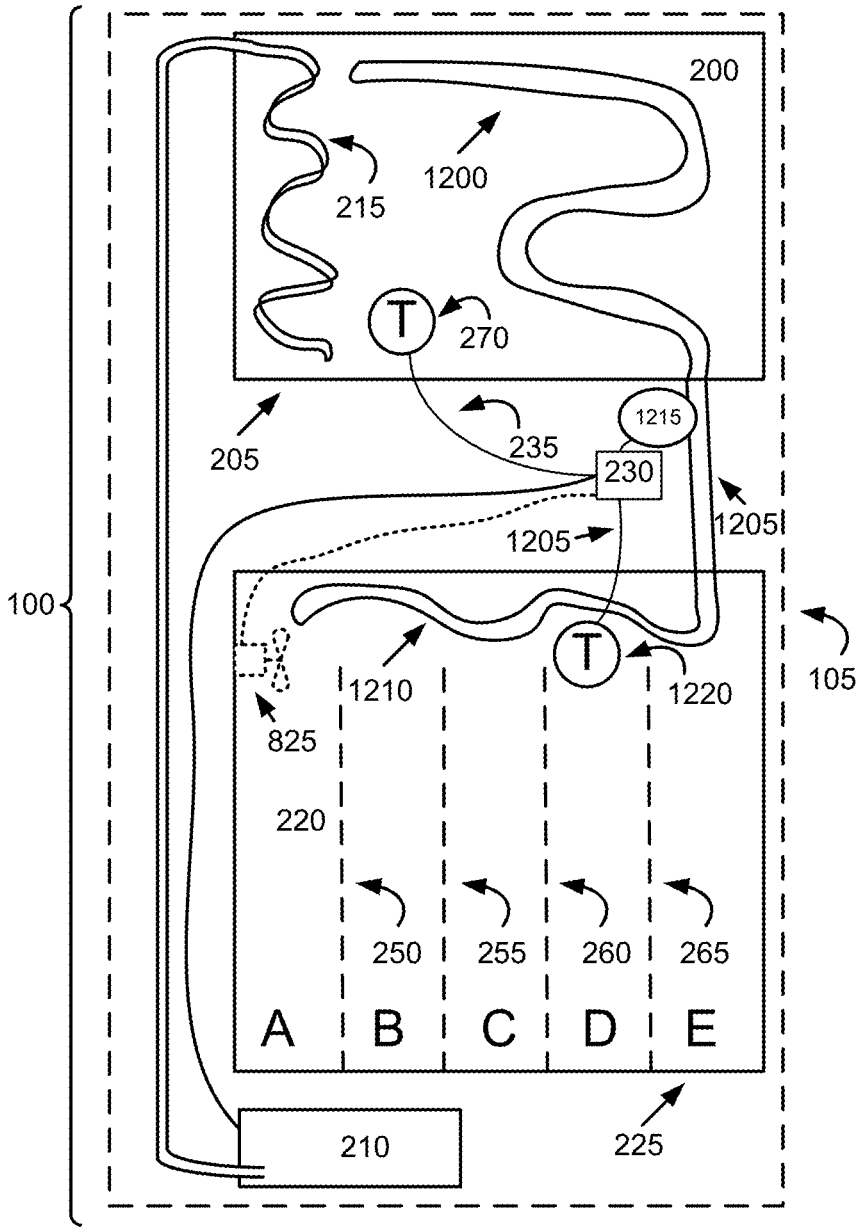
FIG. 12 is a schematic of aspects of a refrigeration device.

FIG. 12 depicts aspects of a refrigeration device 100. The refrigeration device 100 includes a container 200 with one or more walls 205 sealed to hold a quantity of PCM within the container 200. The refrigeration device 100 includes a refrigeration compressor unit 210 including the set of refrigeration coils 215, wherein the set of refrigeration coils 215 are in thermal contact with the PCM inside the container 200. In the illustrated embodiment, the refrigeration coils 215 traverse the walls 205 of the container 200 and are in direct contact with the PCM within the container 200. In some embodiments, the refrigeration coils are in thermal contact with the PCM through the walls of the container.

The refrigeration device 100 includes one or more walls 225 forming a storage region 220. The storage region 220 can include one or more partitions 250, 255, 260, 265 forming one or more regions A, B, C, D, E within the storage region 220, each region of a size, shape and position to hold a cold pack. The storage region 220 can also include one or more fans 825 affixed to the walls 225 of the storage region 220. One or more fans 825 can be operably connected to the controller 230.

The refrigeration device 100 includes a set of hollow tubes sealed to form a refrigerant loop 1205, the refrigerant loop containing a liquid. The liquid can be a liquid that has a sufficiently high specific heat for the use situation with a corresponding low viscosity at low thermal temperatures. A liquid can include a glycol/water mixture, for example. A first end 1200 of the refrigerant loop in thermal contact with the PCM within the container 200. For example, the first end of the refrigerant loop can traverse the wall 205 of the container 200 to be in direct contact with the PCM within the container. For example, the first end of the refrigerant loop can be in thermal contact with the wall 205 and the PCM through the wall 205. A second end 1210 of the refrigerant loop 1205 is in thermal contact with the storage region 220. For example, the second end 1210 of the refrigerant loop 1205 can traverse the wall 225 of the storage region 220 and be positioned within the storage region 220. For example, the second end 1210 of the refrigerant loop 1205 can be in thermal contact with the storage region 220 through the wall 225. A pump 1215 is operably connected to the refrigerant loop 1205, the pump 1215 of a type to move the liquid through the refrigerant loop 1205 under control of the controller 230 operably connected to the pump 1215. A temperature sensor 270 can be positioned within the container 200, the temperature sensor 270 configured to send temperature information to the controller 230. A temperature sensor 1220 can be positioned within the storage region 220, the temperature sensor 1220 configured to send temperature information to the controller 230. The controller 230 can be configured to send control signals to the pump 1215 in response to signals from one or more of the temperature sensors 270, 1220. The controller 230 can be configured to send control signals to the refrigeration compressor unit 210 in response to signals from one or more of the temperature sensors 270, 1220.

In some embodiments, a refrigeration device includes: a container with one or more walls sealed to hold a quantity of PCM; a first refrigeration compressor unit including the set of refrigeration coils, wherein the set of refrigeration coils are in thermal contact with the PCM; one or more walls forming a storage region; a second refrigeration compressor unit including the set of refrigeration coils, wherein the set of refrigeration coils include a first section in thermal contact with the PCM and a second section in thermal contact with the storage region; and a controller operably connected to the first refrigeration compressor unit and the second refrigeration compressor unit.

Figure 13:
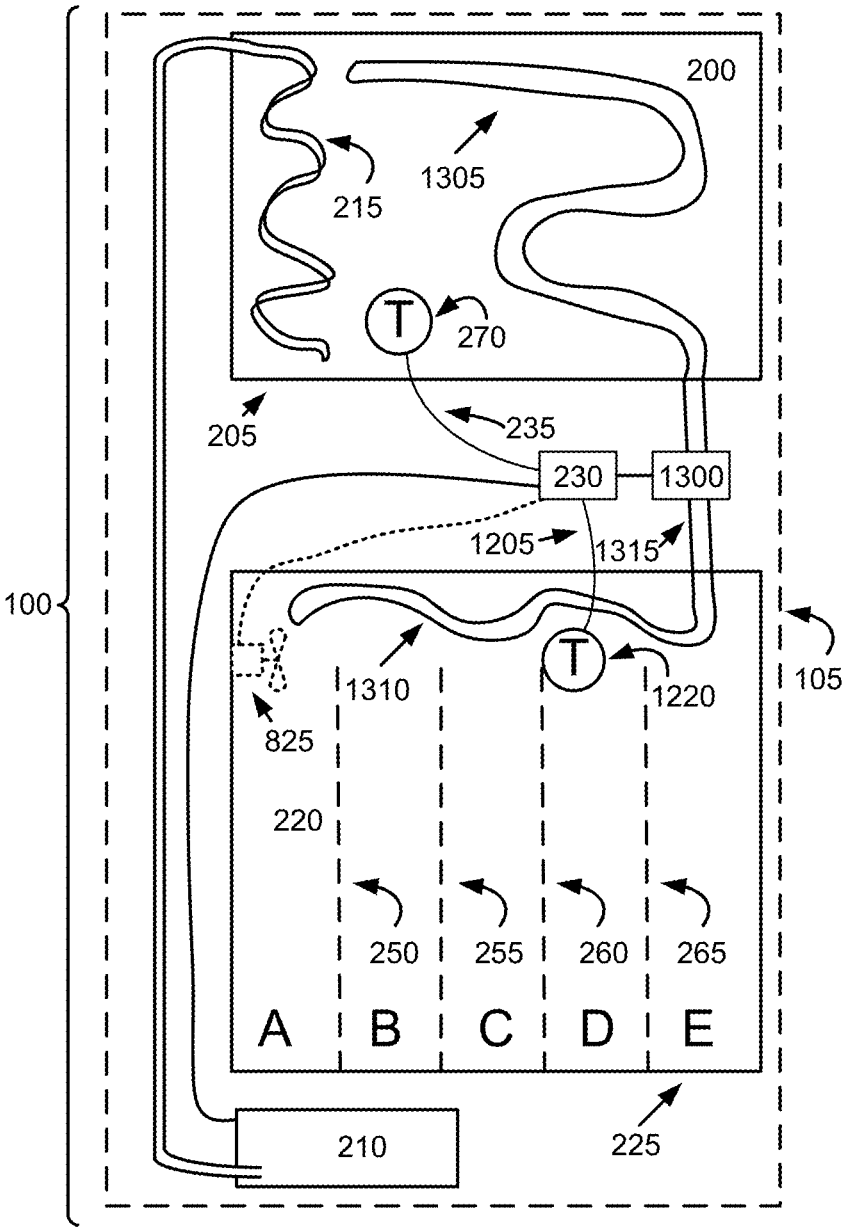
FIG. 13 is a schematic of aspects of a refrigeration device.

FIG. 13 depicts a refrigeration device 100 similar to the one depicted in FIG. 12. In the embodiment illustrated in FIG. 13, the refrigeration device 100 includes a second refrigeration compressor unit 1300. The second refrigeration compressor unit 1300 includes a first set of refrigeration coils 1305 in thermal contact with the PCM within the container 200 and a second set of refrigeration coils 1310 in thermal contact with the storage region 220. The second refrigeration compressor unit 1300 is operably connected to the controller 230. The controller 230 can be configured to send control signals to the second refrigeration compressor unit 1300 in response to signals from one or more of the temperature sensors 270, 1220. The controller 230 can be configured to send control signals to the first refrigeration compressor unit 210 in response to signals from one or more of the temperature sensors 270, 1220.

The state of the art has progressed to the point where there is little distinction left between hardware, software (e.g., a high-level computer program serving as a hardware specification), and/or firmware implementations of aspects of systems; the use of hardware, software, and/or firmware is generally (but not always, in that in certain contexts the choice between hardware and software can become significant) a design choice representing cost vs. efficiency tradeoffs. There are various vehicles by which processes and/or systems and/or other technologies described herein can be effected (e.g., hardware, software (e.g., a high-level computer program serving as a hardware specification), and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; alternatively, if flexibility is paramount, the implementer may opt for a mainly software (e.g., a high-level computer program serving as a hardware specification) implementation; or, yet again alternatively, the implementer may opt for some combination of hardware, software (e.g., a high-level computer program serving as a hardware specification), and/or firmware in one or more machines, compositions of matter, and articles of manufacture, limited to patentable subject matter under 35 U.S.C. § 101. Hence, there are several possible vehicles by which the processes and/or devices and/or other technologies described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary.

In some implementations described herein, logic and similar implementations may include computer programs or other control structures. Electronic circuitry, for example, may have one or more paths of electrical current constructed and arranged to implement various functions as described herein. In some implementations, one or more media may be configured to bear a device-detectable implementation when such media hold or transmit device detectable instructions operable to perform as described herein. In some variants, for example, implementations may include an update or modification of existing software (e.g., a high-level computer program serving as a hardware specification) or firmware, or of gate arrays or programmable hardware, such as by performing a reception of or a transmission of one or more instructions in relation to one or more operations described herein. Alternatively or additionally, in some variants, an implementation may include special-purpose hardware, software (e.g., a high-level computer program serving as a hardware specification), firmware components, and/or general-purpose components executing or otherwise invoking special-purpose components. Specifications or other implementations may be transmitted by one or more instances of tangible transmission media as described herein, optionally by packet transmission or otherwise by passing through distributed media at various times.

Alternatively or additionally, implementations may include executing a special-purpose instruction sequence or invoking circuitry for enabling, triggering, coordinating, requesting, or otherwise causing one or more occurrences of virtually any functional operation described herein. In some variants, operational or other logical descriptions herein may be expressed as source code and compiled or otherwise invoked as an executable instruction sequence. In some contexts, for example, implementations may be provided, in whole or in part, by source code, such as C++, or other code sequences. In other implementations, source or other code implementation, using commercially available and/or techniques in the art, may be compiled/implemented/translated/converted into a high-level descriptor language (e.g., initially implementing described technologies in C or C++ programming language and thereafter converting the programming language implementation into a logic-synthesizable language implementation, a hardware description language implementation, a hardware design simulation implementation, and/or other such similar mode(s) of expression). For example, some or all of a logical expression (e.g., computer programming language implementation) may be manifested as a Verilog-type hardware description (e.g., via Hardware Description Language (HDL) and/or Very High Speed Integrated Circuit Hardware Descriptor Language (VHDL)) or other circuitry model which may then be used to create a physical implementation having hardware (e.g., an Application Specific Integrated Circuit).

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood that each function and/or operation within such block diagrams, flowcharts, or examples can be implemented individually and/or collectively, by a wide range of hardware, software (e.g., a high-level computer program serving as a hardware specification), firmware, or virtually any combination thereof, limited to patentable subject matter under 35 U.S.C. 101. In an embodiment, several portions of the subject matter described herein may be implemented via Application Specific Integrated Circuits (ASICs), Field Programmable Gate Arrays (FPGAs), digital signal processors (DSPs), or other integrated formats. However, some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, limited to patentable subject matter under 35 U.S.C. 101, and that designing the circuitry and/or writing the code for the software (e.g., a high-level computer program serving as a hardware specification) and or firmware would be well within the skill of one of skill in the art in light of this disclosure. The mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link (e.g., transmitter, receiver, transmission logic, reception logic, etc.), etc.).

In a general sense, the various aspects described herein which can be implemented, individually and/or collectively, by a wide range of hardware, software (e.g., a high-level computer program serving as a hardware specification), firmware, and/or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.), and/or electrical circuitry forming a communications device (e.g., a modem, communications switch, optical-electrical equipment, etc.). The subject matter described herein may be implemented in an analog or digital fashion or some combination thereof.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

In some instances, one or more components may be referred to herein as "configured to," "configured by," "configurable to," "operable/operative to," "adapted/adaptable," "able to," "conformable/conformed to," etc. Those skilled in the art will recognize that such terms (e.g. "configured to") generally encompass active-state components and/or inactive-state components and/or standby-state components, unless context requires otherwise.

The herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A refrigeration device, comprising:

a thermal transfer unit including a set of hollow tubes forming an evaporative region, a set of hollow tubes forming a condensing region, and one or more hollow tubes forming an adiabatic region connecting the evaporative region and the condensing region, wherein the hollow tubes are sealed to each other to form a contiguous interior region;

one or more reversible valves operably attached to the one or more hollow tubes forming the adiabatic region;

a container with one or more walls, the one or more walls including an aperture sealed around a set of refrigeration coils and wherein the condensing region of the thermal transfer unit is in thermal contact with the one or more walls;

a refrigeration compressor unit including the set of refrigeration coils, wherein the set of refrigeration coils traverse the one or more walls of the container;

one or more walls forming a storage region, wherein the evaporative region of the thermal transfer unit is in thermal contact with the one or more walls; and a controller operably connected to the one or more reversible valves and the refrigeration compressor unit.

2. The refrigeration device of claim 1, wherein the contiguous interior region of the thermal transfer unit comprises:

a gas pressure less than ambient pressure; and a refrigeration fluid.

3. The refrigeration device of claim 1, wherein the container comprises:

one or more thermal transfer devices positioned within an interior of the container, the one or more thermal transfer devices in thermal contact with the condensing region of the thermal transfer unit.

4. The refrigeration device of claim 1, wherein the storage region comprises:

one or more partitions within the storage region.

5. The refrigeration device of claim 1, further comprising:

a temperature sensor positioned within the storage region, the temperature sensor operably connected to the controller.

6. The refrigeration device of claim 1, further comprising:

a temperature sensor affixed to the container and operably connected to the controller.

7. The refrigeration device of claim 1, further comprising:

a reservoir for refrigeration fluid positioned at a low position within the evaporative region of the thermal transfer unit; and a heater affixed to the reservoir, the heater operably connected to the controller.

8. The refrigeration device of claim 1, further comprising:

a reservoir for refrigeration fluid positioned at a low position within the evaporative region of the thermal transfer unit;

a thermal conduit positioned between the reservoir and an exterior region of the refrigeration device; and a reversible valve operably connected to the thermal conduit, the reversible valve operably connected to the controller.

9. The refrigeration device of claim 1, further comprising:

a second container with one or more walls, the second container in thermal contact with a condenser of the refrigeration compressor unit;

a reservoir for refrigeration fluid positioned at a low position within the evaporative region of the thermal transfer unit;

a thermal conduit positioned between the reservoir and an exterior region of the refrigeration device; and a reversible valve operably connected to the thermal conduit, the reversible valve operably connected to the controller.

10. A refrigeration device, comprising:

a first thermal transfer unit including a set of hollow tubes forming a first evaporative region, a set of hollow tubes forming a first condensing region, and one or more hollow tubes forming a first adiabatic region connecting the first evaporative region and the first condensing region, wherein the hollow tubes are sealed to each other to form a first contiguous interior region;

at least one first reversible valve operably attached to the one or more hollow tubes forming the first adiabatic region;

a first container with one or more walls, the one or more walls including an aperture sealed around a first set of refrigeration coils and wherein the first condensing region of the first thermal transfer unit is in thermal contact with the one or more walls;

a second thermal transfer unit including a set of hollow tubes forming a second evaporative region, a set of hollow tubes forming a second condensing region, and one or more hollow tubes forming a second adiabatic region connecting the second evaporative region and the second condensing region, wherein the hollow tubes are sealed to each other to form a second contiguous interior region;

at least one second reversible valve operably attached to the one or more hollow tubes forming the second adiabatic region;

a second container with one or more walls, the one or more walls including an aperture sealed around a second set of refrigeration coils and wherein the second condensing region of the second thermal transfer unit is in thermal contact with the one or more walls;

a refrigeration compressor unit including the first set of refrigeration coils, wherein the first set of refrigeration coils traverse the one or more walls of the first container, and the second set of refrigeration coils, wherein the second set of refrigeration coils traverse the one or more walls of the second container;

a third reversible valve operably attached to the refrigeration compressor unit at a position to regulate flow through the first set of refrigeration coils and the second set of refrigeration coils, the third reversible valve operably attached to the controller;

one or more walls forming a storage region, wherein the first evaporative region of the first thermal transfer unit and the second evaporative region of the second thermal transfer unit are thermal contact with the one or more walls; and a controller operably connected to the at least one first reversible valve, the at least one second reversible valve, and the refrigeration compressor unit.

11. The refrigeration device of claim 10, wherein the contiguous interior region of the first thermal transfer unit comprises:

a gas pressure less than ambient pressure; and a refrigeration fluid.

12. The refrigeration device of claim 10, wherein the contiguous interior region of the second thermal transfer unit comprises:

a gas pressure less than ambient pressure; and a refrigeration fluid.

13. The refrigeration device of claim 10, wherein the refrigeration compressor unit can operate at variable speeds in response to signals received from the controller.

14. The refrigeration device of claim 10, wherein the first container and the second container each comprise:

one or more thermal transfer devices positioned within an interior of the container, the one or more thermal transfer devices in thermal contact with the condensing region of the thermal transfer unit.

15. The refrigeration device of claim 10, wherein the storage region comprises:

one or more partitions within the storage region.

16. The refrigeration device of claim 10, wherein the storage region comprises:

one or more partitions forming sections within the storage region;

at least one temperature sensor affixed within each section; and at least one indicator positioned adjacent to each of the one or more sections, each indicator operably connected to the controller.

17. The refrigeration device of claim 10, wherein the first container and the second container are positioned above the storage region.

18. The refrigeration device of claim 10, further comprising:

a temperature sensor positioned within the storage region, the temperature sensor operably connected to the controller.

19. The refrigeration device of claim 10, further comprising:

a temperature sensor affixed to the first container and operably connected to the controller.

20. The refrigeration device of claim 10, further comprising:

a temperature sensor affixed to the second container and operably connected to the controller.

21. The refrigeration device of claim 10, further comprising:

a reservoir for refrigeration fluid positioned at a low position within the evaporative region of the first thermal transfer unit; and a heater affixed to the reservoir, the heater operably connected to the controller.

22. The refrigeration device of claim 10, further comprising:

a reservoir for refrigeration fluid positioned at a low position within the evaporative region of the second thermal transfer unit; and a heater affixed to the reservoir, the heater operably connected to the controller.

* * * * *